US011436982B2

(12) United States Patent
Kang et al.

(10) Patent No.: US 11,436,982 B2
(45) Date of Patent: Sep. 6, 2022

(54) DATA DRIVER CIRCUIT, CONTROLLER, DISPLAY DEVICE, AND METHOD OF DRIVING THE SAME

(71) Applicant: LG DISPLAY CO., LTD., Seoul (KR)

(72) Inventors: JiHyun Kang, Paju-si (KR); HyunHaeng Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 215 days.

(21) Appl. No.: 16/529,683

(22) Filed: Aug. 1, 2019

(65) Prior Publication Data

US 2020/0043420 A1 Feb. 6, 2020

(30) Foreign Application Priority Data

Aug. 6, 2018 (KR) ..... 10-2018-0091241

(51) Int. Cl.

| | |
|---|---|
| ***G09G 3/3291*** | (2016.01) |
| ***G09G 3/3283*** | (2016.01) |
| ***G09G 3/3275*** | (2016.01) |
| ***G09G 3/3266*** | (2016.01) |

(52) U.S. Cl.

CPC ..... *G09G 3/3291* (2013.01); *G09G 3/3266* (2013.01); *G09G 3/3275* (2013.01); *G09G 3/3283* (2013.01); *G09G 2300/0413* (2013.01); *G09G 2300/0426* (2013.01); *G09G 2300/0439* (2013.01); *G09G 2300/0809* (2013.01)

(58) Field of Classification Search

CPC .. G09G 3/3291; G09G 3/3283; G09G 3/3266; G09G 3/3275; G09G 2300/0413; G09G 2300/0426; G09G 2300/0439; G09G 2300/0809

See application file for complete search history.

(56) References Cited

U.S. PATENT DOCUMENTS

| | | | | |
|---|---|---|---|---|
| 2003/0179221 | A1 | 9/2003 | Nitta et al. | |
| 2005/0168491 | A1* | 8/2005 | Takahara | G09G 3/325 345/690 |
| 2006/0176261 | A1* | 8/2006 | Nitta | G09G 3/3648 345/94 |
| 2007/0024557 | A1 | 2/2007 | Rho et al. | |
| 2010/0238151 | A1* | 9/2010 | Kitayama | G09G 3/3614 345/209 |
| 2015/0161940 | A1* | 6/2015 | Woo | G09G 3/003 345/58 |
| 2018/0174516 | A1 | 6/2018 | Kim et al. | |

FOREIGN PATENT DOCUMENTS

| | | | |
|---|---|---|---|
| EP | 3 327 713 | A1 | 5/2018 |
| JP | 2003280600 | A | 10/2003 |
| JP | 2008225492 | A | 9/2008 |
| JP | 2013174813 | A | 9/2013 |

(Continued)

*Primary Examiner* — William Boddie
*Assistant Examiner* — Saifeldin E Elnafia
(74) *Attorney, Agent, or Firm* — Seed IP Law Group LLP

(57) ABSTRACT

Various embodiments provide a data driver circuit, a controller, a display device, and a method of driving the same. Overlap driving of overlapping subpixels and fake data insertion driving of inserting a fake image, different from real images, into each of a plurality of lines are performed in a combined manner. Image quality is improved, despite of combined driving.

15 Claims, 22 Drawing Sheets

(56) References Cited

FOREIGN PATENT DOCUMENTS

| | | | |
|---|---|---|---|
| JP | 2017120409 | A | 7/2017 |
| KR | 10-2007-0035297 | A | 3/2007 |
| KR | 10-1127845 | | 3/2012 |
| KR | 20160047674 | A | 5/2016 |
| KR | 20180025514 | A | 3/2018 |
| KR | 10-2018-0060334 | A | 6/2018 |
| KR | 20180060530 | A | 6/2018 |
| TW | 200723893 | A | 6/2007 |
| WO | 2011/125113 | A | 10/2011 |

* cited by examiner

FIG. 19

LUT

| | | Range 1 | Range 2 | Range 3 | Range 4 | Range 5 |
|---|---|---|---|---|---|---|
| Red (R) | Gain | GR1 | GR2 | GR3 | GR4 | GR5 |
| | Offset | OR1 | OR2 | OR3 | OR4 | OR5 |
| Green (G) | Gain | GG1 | GG2 | GG3 | GG4 | GG5 |
| | Offset | OG1 | OG2 | OG3 | OG4 | OG5 |
| Blue (B) | Gain | GB1 | GB2 | GB3 | GB4 | GB5 |
| | Offset | OB1 | OB2 | OB3 | OB4 | OB5 |
| White (W) | Gain | GW1 | GW2 | GW3 | GW4 | GW5 |
| | Offset | OW1 | OW2 | OW3 | OW4 | OW5 |

DATA DRIVER CIRCUIT, CONTROLLER, DISPLAY DEVICE, AND METHOD OF DRIVING THE SAME

CROSS REFERENCE TO RELATED APPLICATION

This application claims priority to Korean Patent Application No. 10-2018-0091241, filed on Aug. 6, 2018, which is hereby incorporated by reference for all purposes as if fully set forth herein.

BACKGROUND

Technical Field

Exemplary embodiments relate to a data driver circuit, a controller, a display device, and a method of driving the same.

Description of the Related Art

In response to the development of the information society, demand for a variety of types of display devices for displaying images is increasing. In this regard, a range of display devices, such as liquid crystal display (LCD) devices, plasma display devices, and organic light-emitting diode (OLED) display devices, have recently come into widespread use.

Such a display device can perform display driving by charging capacitors respectively disposed in each subpixel among a plurality of subpixels arrayed in a display panel. However, in display devices of the related art, some subpixels may be insufficiently charged, thereby degrading image quality, which is problematic. In addition, in the related art, an image may be blurred instead of being clearly distinguishable, or luminance differences may be caused due to different emission periods depending on line position, thereby degrading image quality.

BRIEF SUMMARY

Various embodiments of the present disclosure provide a data driver circuit, a controller, a display device, and a method of driving the same that can improve the state of charge by performing overlap driving of the subpixels, thereby improving image quality.

Also provided are a data driver circuit, a controller, a display device, and a method of driving the same that can reduce or prevent luminance differences due to image blurring or different emission periods depending on line position by performing the fake data insertion (FDI) driving of inserting a fake image, different from real images, into some of a plurality of lines, thereby improving image quality.

Also provided are a data driver circuit, a controller, a display device, and a method of driving the same that can combine the overlap driving and the fake data insertion driving, thereby further improving image quality.

Also provided are a data driver circuit, a controller, a display device, and a method of driving the same that can prevent the periodic appearance of bright stripes, which may be caused by combining the overlap driving and the fake data insertion driving, immediately before the insertion of the fake data, thereby further improving image quality.

According to one embodiment, a display device includes a display panel having a plurality of subpixels, wherein the plurality of subpixels includes a first subpixel row, a second subpixel row and a third subpixel row arranged sequentially, wherein a first driving period, in which a scanning signal having a turn-on level is supplied to subpixels in the first subpixel row, and a second driving period, in which the scanning signal having the turn-on level is supplied to subpixels in the second subpixel row, overlap each other, the second driving period and a third driving period, in which the scanning signal having the turn-on level is supplied to subpixels in the third subpixel row, do not overlap each other, during the first, second and third driving periods, a video data voltage is sequentially supplied to the subpixels in the first subpixel row, the subpixels in the second subpixel row, and the subpixels in the third subpixel row, and during a fake data insertion period corresponding to a period between the second driving period and the third driving period, a fake data voltage, which is different from the video data voltage, is supplied to two or more of the plurality of subpixels in the display panel, wherein the second driving period includes an overlapping period that overlaps the first driving period and a non-overlapping period that does not overlap either the first driving period or the third driving period, wherein a voltage of a source node or a drain node of a driving transistor electrically connected to an organic light-emitting diode included in the subpixels in the second subpixel row, during the non-overlapping period of the second driving period, is lower than a voltage of the source node or the drain node, during the overlapping period of the second driving period, wherein the video data voltage, supplied to the subpixels in the second subpixel row during the non-overlapping period of the second driving period is lower than the video data voltage supplied to the subpixels in the second subpixel row during the overlapping period of the second driving period. It may be said that, by "not overlapping either the first driving period or the third driving period" it is meant that the first driving period is not overlapped and the third driving period is not overlapped.

A difference between the video data voltage supplied to the subpixels in the second subpixel row during the overlapping period of the second driving period and the video data voltage supplied to the subpixels in the second subpixel row during the non-overlapping period of the second driving period, is equal to a difference between the voltage of the source node or the drain node during the overlapping period of the second driving period and the voltage of the source node or the drain node during the non-overlapping period of the second driving period.

The display panel includes a plurality of data lines and a plurality of gate lines, the subpixels in the first subpixel row, the subpixels in the second subpixel row, and the subpixels in the third subpixel row are defined by the plurality of data lines and the plurality of gate lines, wherein the video data voltage is sequentially supplied to a first subpixel, a second subpixel, and a third subpixel located in the first subpixel row, the second subpixel row, and the third subpixel row respectively by a first data line of the plurality of data lines, the first subpixel, the second subpixel and the third subpixel are located on a same subpixel column and are electrically connected to the first data line and a first reference voltage line, and wherein the fake data voltage is supplied simultaneously to the two or more subpixels in two or more subpixel rows through the first data line.

Each of the first subpixel, the second subpixel, and the third subpixel includes: the organic light-emitting diode having a first electrode and a second electrode; the driving transistor driving the organic light-emitting diode; a first transistor electrically connected between a first node of the driving transistor and the first data line; a second transistor electrically connected between a second node of the driving transistor and the first reference voltage line; and a storage capacitor electrically connected between the first node and the second node of the driving transistor, wherein the first driving period is a turn-on level period of a first scanning signal applied to a gate node of the first transistor included in the first subpixel, the second driving period is a turn-on level period of the first scanning signal applied to a gate node of the first transistor included in the second subpixel, and the third driving period is a turn-on level period of the first scanning signal applied to a gate node of the first transistor included in the third subpixel, wherein the voltage of the gate node of the driving transistor included in the second subpixel, during the non-overlapping period of the second driving period, is lower than the voltage of the gate node of the driving transistor included in the second subpixel, during the overlapping period of the second driving period.

A difference between the voltage of the gate node of the driving transistor included in the second subpixel during the overlapping period and the non-overlapping period of the second driving period is equal to a difference between the voltage of the source node or the drain node during the overlapping period of the second driving period and the voltage of the source node or the drain node during the non-overlapping period of the second driving period.

The time lengths of the overlapping period and the non-overlapping period of the second driving period may correspond to each other.

The overlapping period of the second driving period may overlap a rear portion of the first driving period, with pre-charge driving being performed therein. Here, the video data writing may be performed in the rear portion of the first driving period.

The non-overlapping period of the second driving period may not overlap a front portion of the third driving period, with video data writing being performed therein. Here, the pre-charge driving may be performed in the front portion of the third driving period.

The video data voltage, supplied to the second subpixel during the non-overlapping period of the second driving period, may vary depending on colors of light emitted by the second subpixel.

The video data voltage, supplied to the second subpixel during the non-overlapping period of the second driving period, may vary depending on gray levels of light emitted by the second subpixel.

The display device may include a color-specific lookup table referred to when the video data voltage, supplied to the second subpixel during the non-overlapping period of the second driving period, is changed.

The lookup table may include information regarding gain and offset varying depending on changes in gray level or information regarding gain and offset respectively corresponding to two or more gray level ranges.

The fake data voltage, supplied to the first data line, may correspond to a black data voltage.

Exemplary embodiments may provide a method of driving a display device including a display panel having a plurality of subpixels that are arrayed, the plurality of subpixels including a first subpixel row, a second subpixel row, and a third subpixel row arranged sequentially, the driving method comprising: supplying a scanning signal having a turn-on level to subpixels in the first subpixel row during a first driving period; supplying the scanning signal to subpixels in the second subpixel row during a second driving period starting after a start of the first driving period and before termination of the first driving period; supplying the scanning signal to subpixels in the third subpixel row during a third driving period after termination of the second driving period, during the first, second and third driving periods, a video data voltage is sequentially supplied to the subpixels in the first subpixel row, the subpixels in the second subpixel row, and the subpixels in the third subpixel row, and during a fake data insertion period corresponding to a period between the second driving period and the third driving period, a fake data voltage, which is different from the video data voltage, is supplied to two or more of the plurality of subpixels in the display panel, wherein the second driving period includes an overlapping period that overlaps the first driving period and a non-overlapping period that does not overlap either the first driving period or the third driving period, and wherein a voltage of a source node or a drain node of a driving transistor electrically connected to an organic light-emitting diode included in the pixels in the second subpixel row, during the non-overlapping period of the second driving period, is lower than a voltage of the source node or the drain node, during the overlapping period of the second driving period, wherein the video data voltage, supplied to the subpixels in the second subpixel row during the non-overlapping period of the second driving period, is lower than the video data voltage supplied to the subpixels in the second subpixel row during the overlapping period of the second driving period.

A difference between the video data voltage supplied to the subpixels in the second subpixel row during the overlapping period of the second driving period and the video data voltage supplied to the subpixels in the second subpixel row during the non-overlapping period of the second driving period, is equal to a difference between the voltage of the source node or the drain node during the overlapping period of the second driving period and the voltage of the source node or the drain node during the non-overlapping period of the second driving period.

Exemplary embodiments may provide a display device including a plurality of subpixels that are arrayed, wherein a fake image, different from real images, is displayed in an active period in a one-frame period, a fake data voltage, corresponding to the fake image, is supplied to a subpixel during the active period in which the fake image is displayed, a scanning signal having a turn-on level is supplied to the subpixel, during a driving period before the active period, and wherein the driving period includes a first period and a second period, a voltage of a source node or a drain node of a driving transistor included in the subpixel, during the first period, is lower than a voltage of the source node or the drain node of the driving transistor included in the subpixel, during the second period, wherein a video data voltage, supplied to the subpixel during the second period is lower than the video data voltage during the first period.

A difference between the video data voltage during the first period and the video data voltage during the second period is equal to a difference between the voltage of the source node or the drain node during the first period and the voltage of the source node or the drain node during the second period.

Exemplary embodiments may provide a data driver circuit configured to drive a plurality of data lines disposed in a display panel, the data driver circuit comprising: a latch circuit storing video data; a digital-to-analog converter converting the video data into an analog data voltage; and an output buffer outputting the data voltage, wherein a plurality of subpixels are arranged in the display panel, the plurality of subpixels includes a first subpixel row, a second subpixel row and a third subpixel row arranged sequentially, a first driving period, in which a scanning signal having a turn-on level is supplied to subpixels in the first subpixel row, and a second driving period, in which the scanning signal having the turn-on level is supplied to subpixels in the second subpixel row, overlap each other, the second driving period and a third driving period, in which the scanning signal having the turn-on level is supplied to subpixels in the third subpixel row, do not overlap each other, wherein during the first driving period, the second driving period and the third driving period, the output buffer sequentially supplies a video data voltage to the subpixels in the first subpixel row, the subpixels in the second subpixel row, and the subpixels in the third subpixel row through a first data line, and during a fake data insertion period corresponding to a period between the second driving period and the third driving period, the output buffer supplies a fake data voltage, which is different from the video data voltage, to two or more of the plurality of subpixels in the display panel, wherein the second driving period includes an overlapping period that overlaps the first driving period and a non-overlapping period that does not overlap either the first driving period or the third driving period, and wherein a voltage of a source node or a drain node of a driving transistor electrically connected to an organic light-emitting diode included in the subpixels in the second subpixel row, during the non-overlapping period of the second driving period, is lower than a voltage of the source node or the drain node, during the overlapping period of the second driving period, wherein the video data voltage, supplied to the subpixels in the second subpixel row during the non-overlapping period of the second driving period, is lower than the video data voltage supplied to the subpixels in the second subpixel row during the overlapping period of the second driving period.

Exemplary embodiments may provide a controller comprising: a driving controller controlling a data driver circuit and a gate driver circuit; and a data output portion outputting video data to the data driver circuit, wherein a plurality of subpixels are arrayed in a display panel, the display panel includes a first subpixel row, a second subpixel row and a third subpixel row arranged sequentially, the driving controller controls a first driving period, in which a scanning signal having a turn-on level is supplied to subpixels in the first subpixel row, and a second driving period, in which the scanning signal having the turn-on level is supplied to subpixels in the second subpixel row, to overlap each other, the driving controller controls the second driving period and a third driving period, in which the scanning signal having the turn-on level is supplied to subpixels in the third subpixel row, not to overlap each other, during the first, second and third driving periods, the data output portion outputs the video data to the data driver circuit, the data driver circuit supplies the video data sequentially to the subpixels in the first subpixel row, the subpixels in the second subpixel row, and the subpixels in the third subpixel row, and during a fake data insertion period corresponding to a period between the second driving period and the third driving period, the data output portion outputs a fake data, which is different from the video data to the data driver circuit, the data driver circuit supplies the fake data to two or more of the plurality of subpixels in the display panel, wherein the second driving period includes an overlapping period that overlaps the first driving period and a non-overlapping period that does not overlap either the first driving period or the third driving period, wherein a voltage of a source node or a drain node of a driving transistor electrically connected to an organic light-emitting diode included in the subpixels in the second subpixel row, during the non-overlapping period of the second driving period, is lower than a voltage of the source node or the drain node, during the overlapping period of the second driving period, wherein a voltage of the video data, supplied to the subpixels in the second subpixel row during the non-overlapping period of the second driving period is lower than a voltage of the video data supplied to the subpixels in the second subpixel row during the overlapping period of the second driving period.

According to exemplary embodiments, it is possible to improve the state of charge by performing overlap driving of the subpixels, thereby improving image quality.

According to exemplary embodiments, it is possible to reduce or prevent luminance differences due to image blurring or different emission periods depending on line position by performing the fake data insertion (FDI) driving of inserting a fake image, different from real images, into every line of a plurality of lines, thereby improving image quality.

According to exemplary embodiments, it is possible to combine the overlap driving and the fake data insertion driving, thereby further improving image quality.

According to exemplary embodiments, it is possible to prevent the periodic appearance of bright stripes, which may be caused by combining the overlap driving and the fake data insertion driving, immediately before the insertion of the fake data, thereby further improving image quality.

BRIEF DESCRIPTION OF THE DRAWINGS

The above and other features, and advantages of the present disclosure will be more clearly understood from the following detailed description when taken in conjunction with the accompanying drawings, in which:

FIG. 19 illustrates a lookup table for the color-specific data control in the display device according to exemplary embodiments;

DETAILED DESCRIPTION

Figure 1:
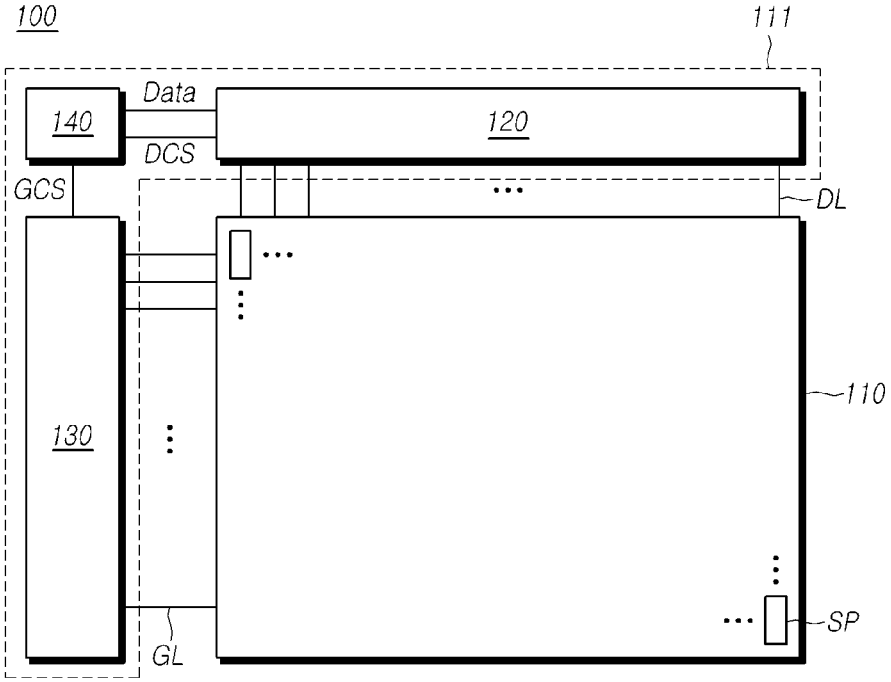
FIG. 1 illustrates a schematic configuration of a display device according to exemplary embodiments.

Hereinafter, reference will be made to embodiments of the present disclosure in detail, examples of which are illustrated in the accompanying drawings. Throughout this document, reference should be made to the drawings, in which the same reference numerals and symbols will be used to designate the same or like components. In the following description of the present disclosure, detailed descriptions of known functions and components incorporated herein will be omitted in the case that the subject matter of the present disclosure may be rendered unclear thereby.

It will also be understood that, while terms, such as "first," "second," "A," "B," "(a)," and "(b)," may be used herein to describe various elements, such terms are merely used to distinguish one element from other elements. The substance, sequence, order, or number of such elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element.

FIG. 1 illustrates a schematic configuration of a display device 100 according to exemplary embodiments.

Referring to FIG. 1, the display device 100 according to exemplary embodiments includes a display panel 110 and a driver circuit 111 driving the display panel 110. In the display panel 110, a plurality of data lines DL and a plurality of gate lines GL are disposed, and a plurality of subpixels SP defined by the plurality of data lines DL and the plurality of gate lines GL are arrayed. It may be said that, by "are arrayed" it is meant that the plurality of subpixels SP are arranged in the form of a matrix. The matrix comprising one or more rows and one or more columns.

The driver circuit 111, in terms of the function, may include a data driver circuit 120 driving the plurality of data lines DL, a gate driver circuit 130 driving the plurality of gate lines GL, and a controller 140 controlling the data driver circuit 120 and the gate driver circuit 130.

In the display panel 110, the plurality of data lines DL and the plurality of gate lines GL may overlap each other. For example, the plurality of data lines DL may be disposed in rows or columns, while the plurality of gate lines GL may be disposed in columns or rows. Hereinafter, the plurality of data lines DL will be regarded as being disposed in columns, while the plurality of gate lines GL will be regarded as being disposed in rows, for the sake of brevity.

The controller 140 controls the data driver circuit 120 and gate driver circuit 130 by transferring a variety of control signals DCS and GCS for driving of the data driver circuit 120 and gate driver circuit 130.

The controller 140 starts scanning at points in time defined by frames, outputs converted video data Data by converting video data input from an external source into a data signal format readable by the data driver circuit 120, and controls data driving at appropriate points in time in response to the scanning.

The controller 140 receives a variety of timing signals, including a vertical synchronization signal Vsync, a horizontal synchronization signal Hsync, an input data enable signal DE, and a clock signal CLK, in addition to the input video data, from an external source (e.g., a host system).

The controller 140 not only outputs converted video data Data by converting video data input from an external source into a data signal format readable by the data driver circuit 120, but also receives timing signals, such as a vertical synchronization signal Vsync, a horizontal synchronization signal Hsync, an input data enable signal DE, and a clock signal CLK, and generates and outputs a variety of control signals to the data driver circuit 120 and gate driver circuit 130 in order to control the data driver circuit 120 and gate driver circuit 130.

For example, the controller 140 outputs a variety of gate control signals GCS, including a gate start pulse GSP, a gate shift clock GSC, a gate output enable signal GOE, and the like, to control the gate driver circuit 130.

Here, the gate start pulse GSP is used to control the operation start timing of one or more gate driver integrated circuits (ICs) of the gate driver circuit 130. The gate shift clock GSC is a clock signal commonly input to the one or more gate driver ICs to control the shift timing of scanning signals. The gate output enable signal GOE designates timing information of the one or more gate driver ICs.

In addition, the controller 140 outputs a variety of data control signals DCS, including a source start pulse SSP, a source sampling clock SSC, a source output enable signal SOE, and the like, to control the data driver circuit 120.

Here, the source start pulse SSP is used to control the data sampling start timing of one or more source driver ICs of the data driver circuit 120. The source sampling clock SSC is a clock signal controlling the sampling timing of data in each of the source driver ICs. The source output enable signal SOE controls the output timing of the data driver circuit 120.

The controller 140 may be a timing controller used in typical display technology, or may be a control device including a timing controller and performing other control functions.

The controller 140 may be provided as a component separate from the data driver circuit 120, or may be provided as an IC combined (or integrated) with the data driver circuit 120.

The data driver circuit 120 receives video data Data from the controller 140 and supplies a data voltage to the plurality of data lines DL to drive the plurality of data lines DL. Herein, the data driver circuit 120 may also be referred to as a source driver circuit.

The data driver circuit 120 may include one or more source driver ICs.

Each of the source driver ICs may include a shift register, a latch circuit, a digital-to-analog converter (DAC), an output buffer, and the like.

In some cases, each of the source driver ICs may further include one or more analog-to-digital converters (ADCs).

Each of the source driver ICs may be connected to a bonding pad of the display panel 110 by a tape-automated bonding (TAB) method or by a chip-on-glass (COG) method, may directly mounted on the display panel 110, or in some cases, may be integrated with the display panel 110. In addition, each of the source driver ICs may be implemented using a chip-on-film (COF) structure mounted on a film connected to the display panel 110.

The gate driver circuit 130 sequentially drives the plurality of gate lines GL by sequentially supplying a scanning signal to the plurality of gate lines GL. Herein, the gate driver circuit 130 may also be referred to as a scan driver circuit.

The gate driver circuit 130 may include one or more gate driver ICs.

Each of the gate driver ICs may include a shift register, a level register, and the like.

Each of the gate driver ICs may be connected to a bonding pad of the display panel 110 by a TAB method or a COG method, may be implemented using a gate-in-panel (GIP) structure directly disposed in the display panel 110, or in some cases, may be integrated with the display panel 110. Alternatively, each of the gate driver ICs may be implemented using a COF structure mounted on a film connected to the display panel 110.

The gate driver circuit 130 sequentially supplies the scanning signal having an on or off voltage to the plurality of gate lines GL, under the control of the controller 140.

When a specific gate line is opened by the gate driver circuit 130, the data driver circuit 120 converts the video data Data, received from the controller 140, into an analog data voltage, and supplies the data voltage to the plurality of data lines DL.

The data driver circuit 120 may be disposed on one side of the display panel 110 (e.g., above or below the display panel 110). In some cases, the data driver circuit 120 may be disposed on both sides of the display panel 110 (e.g., above and below the display panel 110), depending on the driving system, the design of the panel, or the like.

The gate driver circuit 130 may be disposed on one side of the display panel 110 (e.g., to the right or left of the display panel 110). In some cases, the gate driver circuit 130 may be disposed on both sides of the display panel 110 (e.g., to the right and left of the display panel 110), depending on the driving system, the design of the panel, or the like.

The display device 100 according to exemplary embodiments may be an organic light-emitting display device, a liquid crystal display (LCD) device, a plasma display device, or the like.

When the display device 100 according to exemplary embodiments is an LCD device, each of the subpixels SP of the display panel 110 may include a pixel electrode, a transistor for transferring a data voltage to the pixel electrode, and the like, and a common electrode, to which a common voltage is applied to generate an electric field together with a pixel voltage (or data voltage) on the pixel electrode of each subpixel SP, may be disposed in the display panel 110.

When the display device 100 according to exemplary embodiments is an organic light-emitting display device, each of the subpixels SP arrayed in the display panel 110 may include an organic light-emitting diode (OLED), i.e., a light-emitting element, and a driving transistor, i.e., a circuit element for driving the OLED.

The type and number of circuit elements of each subpixel SP may be variously determined, depending on the function provided, the design, or the like.

Hereinafter, the display device 100 according to exemplary embodiments will be regarded as an organic light-emitting display device by way of example, for the sake of brevity.

Figure 2:
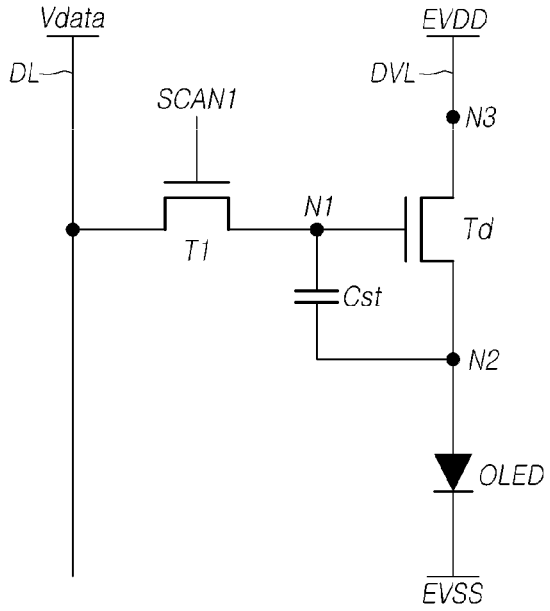
FIG. 2 illustrates a subpixel in the display panel according to exemplary embodiments.
Figure 3:
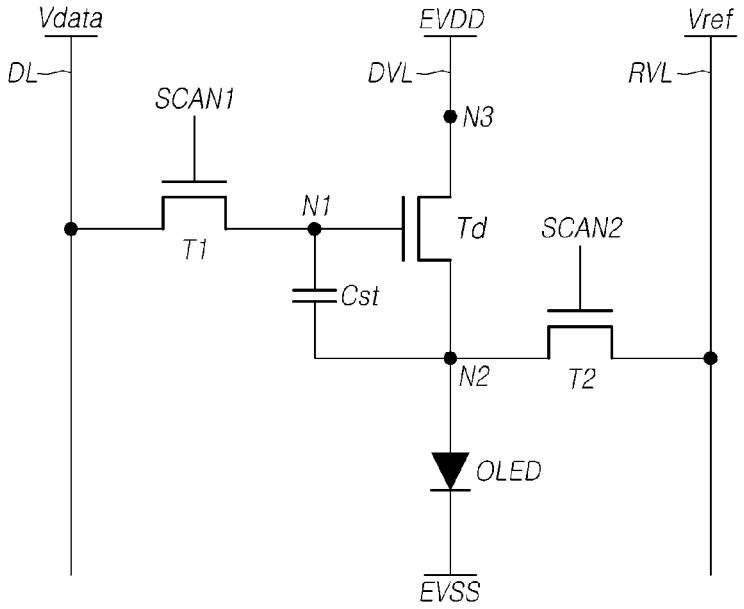
FIG. 3 illustrates another subpixel in the display panel according to exemplary embodiments.

FIG. 2 illustrates a subpixel SP in the display panel 110 according to exemplary embodiments, while FIG. 3 illustrates another subpixel SP in the display panel 110 according to exemplary embodiments.

Referring to FIG. 2, in the display device 100 according to exemplary embodiments, each of the subpixels SP may include an organic light-emitting diode OLED, a driving transistor Td driving the organic light-emitting diode OLED, a first transistor T1 electrically connected between a first node N1 of the driving transistor Td and a corresponding data line DL, a storage capacitor Cst electrically connected to the first node N1 and a second node N2 of the driving transistor Td, and the like.

The organic light-emitting diode OLED may include a first electrode (e.g., an anode or a cathode), an organic light-emitting layer, a second electrode (e.g., a cathode or an anode), and the like.

The first electrode of the organic light-emitting diode OLED may be electrically connected to the second node N2 of the driving transistor Td. A base voltage EVSS may be applied to the second electrode of the organic light-emitting diode OLED. Herein, the base voltage EVSS may be, for example, a ground voltage or a voltage similar to the ground voltage.

The driving transistor Td drives the organic light-emitting diode OLED by supplying driving current to the organic light-emitting diode OLED.

The driving transistor Td may include the first node N1, the second node N2, a third node N3, and the like.

The first node N1 of the driving transistor Td may correspond to a gate node, and may be electrically connected to a source node or a drain node of a first transistor T1. The second node N2 of the driving transistor Td may be electrically connected to the first electrode of the organic light-emitting diode OLED, and may be a source node or a drain node. The third node N3 of the driving transistor Td may be a node, to which a driving voltage EVDD is applied, may be electrically connected to a driving voltage line DVL, through which the driving voltage EVDD is supplied, and may be a drain node or a source node. Hereinafter, the second node N2 and the third node N3 of the driving transistor Td will be regarded as being a source node and a drain node, respectively, by way of example, for the sake of brevity.

The drain node or the source node of the first transistor T1 may be electrically connected to a corresponding data line DL. The source node or the drain node of the first transistor T1 may be electrically connected to the first node N1 of the driving transistor Td. The gate node of the first transistor T1 may be electrically connected to a corresponding gate line, through which a first scanning signal SCAN1 is applied thereto.

The first transistor T1 may be on-off controlled by the first scanning signal SCAN1 applied to the gate node thereof through the corresponding gate line.

The first transistor T1 may be turned on by the first scanning signal SCAN1 to transfer the data voltage Vdata, supplied from the corresponding data line DL, to the first node N1 of the driving transistor Td.

The storage capacitor Cst may be electrically connected between the first node N1 and the second node N2 of the driving transistor Td to maintain the data voltage Vdata corresponding to a video signal voltage or a voltage corresponding to the data voltage Vdata during one frame time.

As described above, the subpixel SP illustrated in FIG. 2 may have a two transistors and one capacitor (2T1C) structure comprised of the two transistors Td and T1 and the single storage capacitor Cst in order to drive the light-emitting diode OLED.

The subpixel structure (2T1C structure) illustrated in FIG. 2 is provided for illustrative purposes, and the present disclosure is not limited thereto. Rather, a single subpixel SP may further include one or more transistors or one or more capacitors, depending on the function, panel structure, design, and the like.

As an example thereof, as illustrated in FIG. 3, a single subpixel SP may have a 3T1C structure further including a second transistor T2 electrically connected between the second node N2 of the driving transistor Td and a reference voltage line RVL.

Referring to FIG. 3, the second transistor T2 may be electrically connected between the second node N2 of the driving transistor Td and the reference voltage line RVL. The second transistor T2 may be on-off controlled by a second scanning signal SCAN2 applied to a gate node thereof.

More specifically, a drain node or a source node of the second transistor T2 may be electrically connected to the reference voltage line RVL, while the source node or the drain node of the second transistor T2 may be electrically connected to the second node N2 of the driving transistor Td. The gate node of the second transistor T2 may be electrically connected to a corresponding gate line, through which the second scanning signal SCAN2 is applied thereto.

For example, the second transistor T2 may be turned on in a period during display driving, and may be turned off in a period during sensing driving in which characteristics of the driving transistor Td or characteristics of the organic light-emitting diode OLED are sensed.

The second transistor T2 may be turned on by the second scanning signal SCAN2 at a corresponding driving time (e.g., a display driving time or a voltage initialization time of the second node N2 of the driving transistor Td in the period during sensing driving) to transfer the reference voltage Vref, supplied to the reference voltage line RVL, to the second node N2 of the driving transistor Td.

In addition, the second transistor T2 may be turned on by the second scanning signal SCAN2 at a corresponding driving time (e.g., a sampling time in the period during sensing driving) to transfer a voltage of the second node N2 of the driving transistor Td to the reference voltage line RVL.

In other words, the second transistor T2 may control the voltage state of the second node N2 of the driving transistor Td or transfer the voltage of the second node N2 of the driving transistor Td to the reference voltage line RVL.

Here, the reference voltage line RVL may be electrically connected to the analog-to-digital converter sensing and converting the voltage of the reference voltage line RVL to a digital value and outputting sensing data including the digital value.

The analog-to-digital converter may be included in the source driver ICs SDIC of the data driver circuit 120.

The sensing data, output from the analog-to-digital converter, may be used to sense characteristics (e.g., a threshold voltage or mobility) of the driving transistor Td or characteristics (e.g., a threshold voltage) of the organic light-emitting diode OLED.

In addition, the storage capacitor Cst may be an external capacitor intentionally designed to be disposed externally of the driving transistor Td, rather than a parasitic capacitor (e.g., Cgs or Cgd), i.e., an internal capacitor present between the first node N1 and the second node N2 of the driving transistor Td.

Each of the driving transistor Td, the first transistor T1, and the second transistor T2 may be an n-type transistor or a p-type transistor.

In addition, the first scanning signal SCAN1 and the second scanning signal SCAN2 may be separate gate signals. In this case, the first scanning signal SCAN1 and the second scanning signal SCAN2 may be applied to the gate node of the first transistor T1 and the gate node of the second transistor T2 through different gate lines, respectively.

In some cases, the first scanning signal SCAN1 and the second scanning signal SCAN2 may be the same gate signal. In this case, the first scanning signal SCAN1 and the second scanning signal SCAN2 may be commonly applied to the gate node of the first transistor T1 and the gate node of the second transistor T2 through the same gate line.

The subpixel structures illustrated in FIGS. 2 and 3 are presented for illustrative purposes, and in some cases, one or more transistors or one or more capacitors may further be included. Alternatively, the plurality of subpixels may have the same structure, or some subpixels among the plurality of subpixels may have a different structure from the remaining subpixels.

Hereinafter, a case in which each of the subpixels SP disposed in the display panel 110 is designed in the 3T1C structure illustrated in FIG. 3 will be taken by way of example, for the sake of brevity.

Hereinafter, the driving operation of each of the subpixels SP will be described in brief by way of example.

The driving operation of each of the subpixels SP may include a video data writing step, a boosting step, and a light emission step.

In the video data writing step, a corresponding video data voltage Vdata may be applied to the first node N1 of the driving transistor Td, and the reference voltage Vref may be applied to the second node N2 of the driving transistor Td. Here, a voltage Vref+ΔV similar to the reference voltage Vref may be applied to the second node N2 of the driving transistor Td, due to resistance components between the second node N2 of the driving transistor Td and the reference voltage line RVL.

In this regard, the first transistor T1 and the second transistor T2 may be turned on at the same time or with a slight time difference due to turn-on voltage levels of the first scanning signal SCAN1 and the second scanning signal SCAN2.

In the video data writing step, the storage capacitor Cst may be charged with an electric charge corresponding to a potential difference between both ends Vdata-Vref or Vdata-(Vref+ΔV).

Application of the video data voltage Vdata to the first node N1 of the driving transistor Td is referred to as video data writing.

In the boosting step subsequent to the video data writing step, the first node N1 and the second node N2 of the driving transistor Td may be electrically floated at the same time or with a slight time difference.

In this regard, the first transistor T1 may be turned off by the turn-off voltage level of the first scanning signal SCAN1. In addition, the second transistor T2 may be turned off by the turn-off voltage level of the second scanning signal SCAN2.

In the boosting step, the voltage of the first node N1 and the voltage of the second node N2 of the driving transistor Td may be boosted while the voltage difference between the first node N1 and the second node N2 of the driving transistor Td is maintained.

When the voltage of the second node N2 of the driving transistor Td arrives at a certain voltage or higher through the boosting of the voltages of the first node N1 and the second node N2 of the driving transistor Td during the boosting step, the operation enters the light emission step.

In this light emission step, driving current flows to the organic light-emitting diode OLED. Then, the organic light-emitting diode OLED can emit light.

Figure 4:
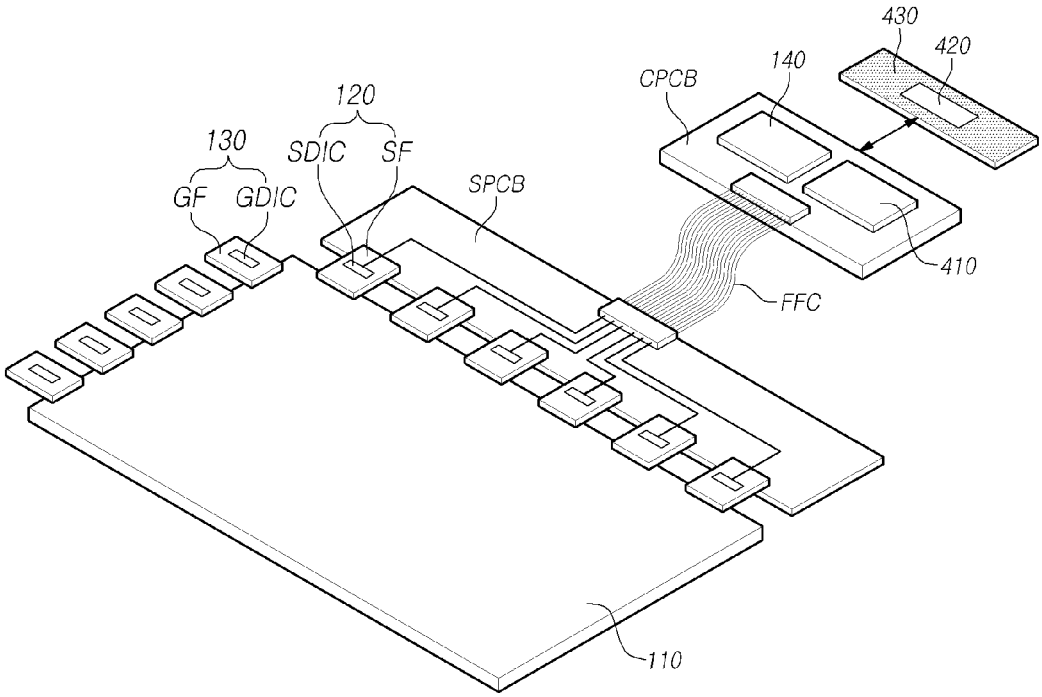
FIG. 4 illustrates a system configuration of the display device according to exemplary embodiments.

FIG. 4 illustrates a system configuration of the display device 100 according to exemplary embodiments.

Referring to FIG. 4, each of the gate driver ICs GDIC may be mounted on a film GF connected to the display panel 110 when the gate driver ICs GDIC are implemented using a COF structure.

Each of the source driver ICs SDIC may be mounted on a film SF connected to the display panel 110 when the source driver ICs SDIC are implemented using a COF structure.

The display device 100 may include at least one source printed circuit board SPCB and a control printed circuit board CPCB, on which control components and a variety of electric devices are mounted, in order to provide circuit connection of the plurality of source driver ICs SDIC to the other devices.

The films SF, on which the source driver ICs SDIC are mounted, may be connected to the at least one source printed circuit board SPCB. That is, one portion of each of the films SF, on which the source driver ICs SDIC are mounted, may be electrically connected to the display panel 110, and the other portion of each of the films SF may be electrically connected to the source printed circuit board SPCB.

The controller 140, a power management IC (PMIC) 410, and the like, may be mounted on the control printed circuit board CPCB. The controller 140 controls the operation of the data driver circuit 120, the gate driver circuit 130, and the like. The power management IC 410 supplies various forms of voltage or current to the display panel 110, the data driver circuit 120, the gate driver circuit 130, and the like, or controls various forms of voltage or current to be supplied to the same.

A circuit connection between the at least one source printed circuit board SPCB and the control printed circuit board CPCB may be enabled by at least one connecting member. Here, the connecting member may be, for example, a flexible printed circuit (FPC), a flexible flat cable (FFC), or the like.

The at least one source printed circuit board SPCB and the control printed circuit board CPCB may be combined (or integrated) into a single printed circuit board.

The display device 100 may further include a set board 430 electrically connected to the control printed circuit board CPCB. The set board 430 may also be referred to as a power board.

A main power management circuit (M-PMC) 420 performing overall power management of the display device 100 may be present on the set board 430.

The power management IC 410 is a circuit managing the power of a display module including the display panel 110 and the driving circuits 120, 130, and 140 of the display panel 110. The main power management circuit 420 is a circuit managing the power of the entire system, including the display module. The main power management circuit 420 may work in concert with the power management IC 410.

Figure 5:
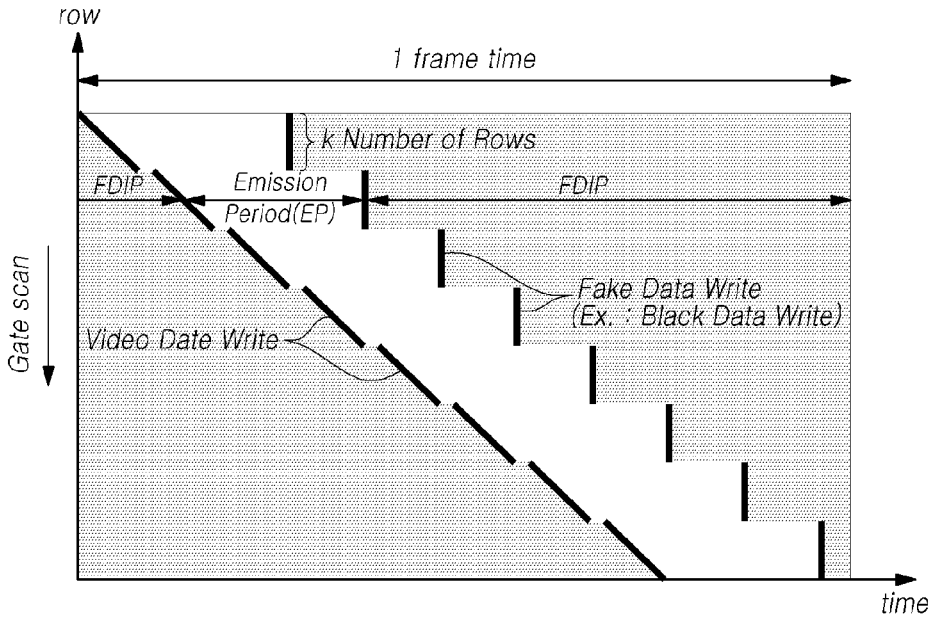
FIG. 5 is a diagram illustrating 2H overlap driving and fake data insertion driving in the display device according to exemplary embodiments.
Figure 6:
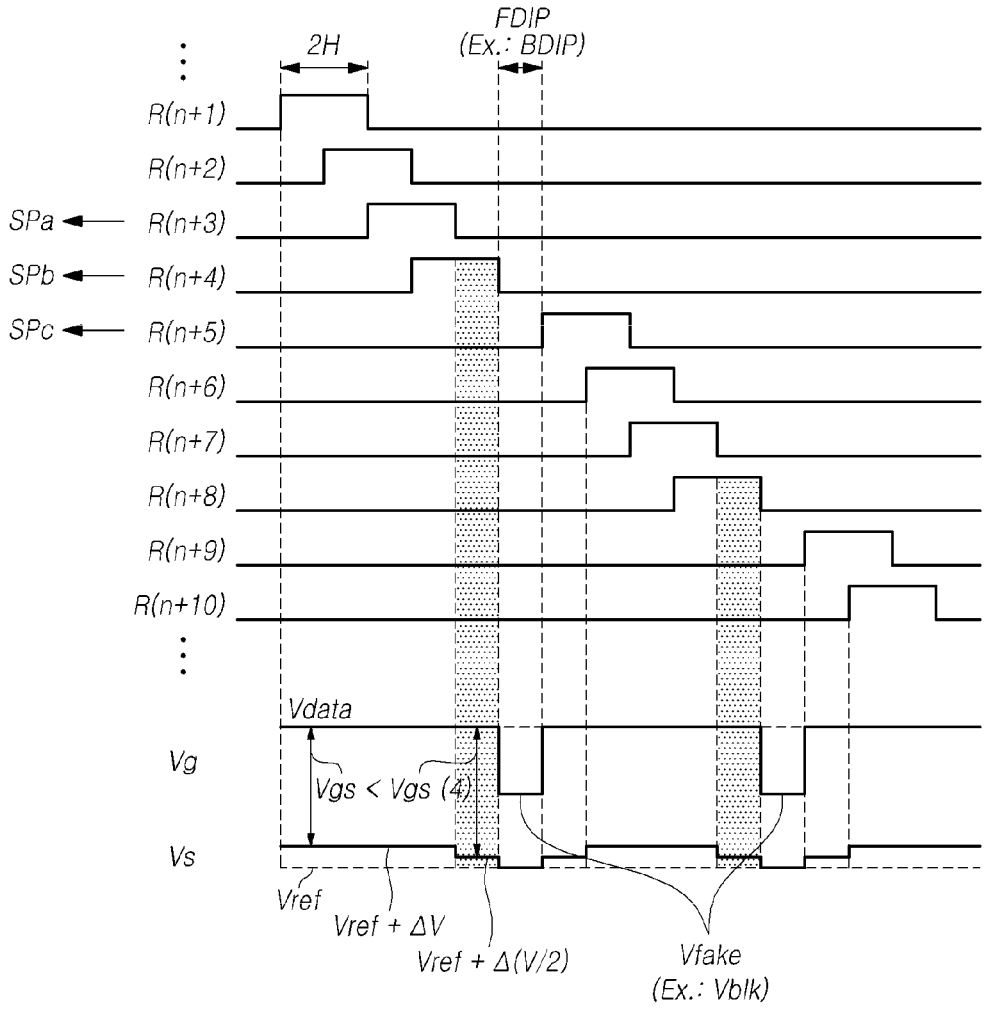
FIG. 6 illustrates the driving timing of the 2H overlap driving and the fake data insertion driving in the display device according to exemplary embodiments.
Figure 7:
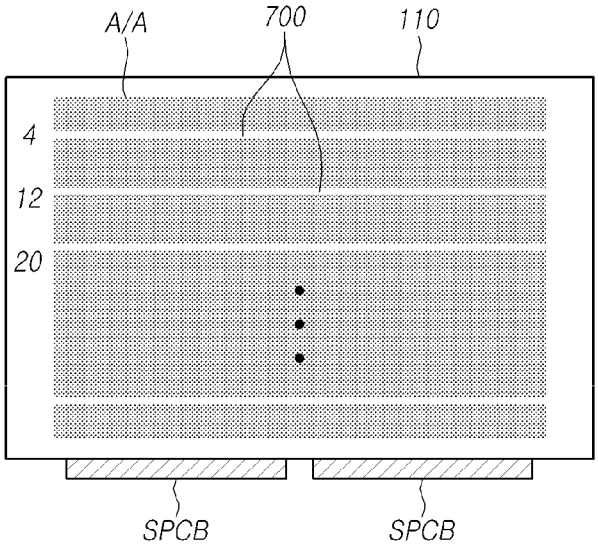
FIG. 7 illustrates an abnormal screen image due to the 2H overlap driving and the fake data insertion driving in the display device according to exemplary embodiments.

FIG. 5 is a diagram illustrating 2H overlap driving and fake data insertion (FDI) driving in the display device 100 according to exemplary embodiments, FIG. 6 illustrates the driving timing of the 2H overlap driving and the fake data insertion driving in the display device 100 according to exemplary embodiments, and FIG. 7 illustrates an abnormal screen image due to the 2H overlap driving and the fake data insertion driving in the display device 100 according to exemplary embodiments.

In the display panel 110 according to exemplary embodiments, the plurality of subpixels SP may be arrayed in the form of a matrix.

A plurality of subpixel rows . . . , R(n+1), R(n+2), R(n+3), R(n+4), R(n+5), and . . . may be present in the display panel 110. It may be said that, the plurality of subpixel rows may be arranged sequentially, such that the R(n+1) row is the top row of display panel 110, the R(n+2) row is the second row of display panel 110 beneath the top row, and the R(n+3) is the third row of display panel 100 beneath the second row. The plurality of subpixel rows . . . , R(n+1), R(n+2), R(n+3), R(n+4), R(n+5), and . . . may be gate-driven sequentially.

When each subpixel of the subpixels SP has a 3T1C structure, one or two gate lines GL, through which the first scanning signal SCAN1 and the second scanning signal SCAN2 are transferred, may be disposed in each of the plurality of subpixel rows . . . , R(n+1), R(n+2), R(n+3), R(n+4), R(n+5), and. . . .

In addition, a plurality of subpixel columns may be present in the display panel 110. One data line DL may be disposed in each of the plurality of subpixel columns, in a corresponding manner.

As in the above-described subpixel driving operation, when the (n+1)th subpixel row R(n+1), among the plurality of subpixel rows . . . , R(n+1), R(n+2), R(n+3), R(n+4), R(n+5), and . . . is driven, the first scanning signal SCAN1 and the second scanning signal SCAN2 are applied to the subpixels SP, among the plurality of subpixels SP, arrayed in the (n+1)th subpixel row R(n+1), and a video data voltage Vdata is applied to the subpixels SP, arrayed in the (n+1)th subpixel row R(n+1), through the plurality of data lines DL.

Afterwards, the (n+2)th subpixel row R(n+2), located below the (n+1)th subpixel row R(n+1), is driven. The first scanning signal SCAN1 and the second scanning signal SCAN2 are applied to the subpixels SP, among the plurality of subpixels SP, arrayed in the (n+2)th subpixel row R(n+2), and the video data voltage Vdata is applied to the subpixels SP, arrayed in the (n+2)th subpixel row R(n+2), through the plurality of data lines DL.

In this manner, video data is written sequentially in the plurality of subpixel rows . . . , R(n+1), R(n+2), R(n+3), R(n+4), R(n+5), and. . . . Here, the video data writing is the procedure performed in the video data writing step of the subpixel driving operation as described above.

The video data writing step, the boosting step, and the light emission step may be sequentially performed on the plurality of subpixel rows . . . , R(n+1), R(n+2), R(n+3), R(n+4), R(n+5), and . . . during one frame time, in response to the above-described subpixel driving operation.

Returning to FIG. 5, in the plurality of subpixel rows . . . , R(n+1), R(n+2), R(n+3), R(n+4), R(n+5), and . . . , an emission period EP does not continue through the entirety of one frame time, due to the light emission step of the subpixel driving operation. Here, the "emission period EP" may also be referred to as a "real image period."

Instead, each of the plurality of subpixel rows . . . , R(n+1), R(n+2), R(n+3), R(n+4), R(n+5), and . . . may be subjected to real display driving and fake data insertion (FDI) driving during one frame time.

During one frame time, a single subpixel SP emits light during the emission period EP by passing through the video data writing step, the boosting step, and the light emission step while the real display driving is being carried out. Subsequently, fake display driving is started.

The fake display driving is fake driving, different from the real display driving for displaying real images.

The fake display driving may be performed by inserting fake images between real images. Thus, the fake display driving is also referred to as the "fake data insertion (FDI) driving."

In the real display driving, the video data voltage Vdata corresponding to real images is supplied to the subpixels SP in order to display real images. In contrast, in the fake data insertion driving, a fake data voltage Vfake corresponding to a fake image, unrelated to real images, is supplied to the subpixels SP.

That is, while the video data voltage Vdata, supplied to the subpixels SP during the real display driving, may vary depending on the frame or the image, the fake data voltage Vfake, supplied to the subpixels SP during the fake data insertion driving, may be constant without varying depending on the frame or the image.

According to a method of the fake data insertion driving, a single subpixel row may be subjected to the fake data insertion driving, and then a next single subpixel row may be subjected to the fake data insertion driving.

In addition, according to another method of the fake data insertion driving, a plurality of subpixel rows may be simultaneously subjected to the fake data insertion driving, and then a plurality of next subpixel rows may be simultaneously subjected to the fake data insertion driving. That is, the fake data insertion driving may be performed simultaneously on each of the plurality of subpixel rows.

The number k of the subpixels simultaneously subjected to the fake data insertion driving may be 2, 4, 8, or the like.

Referring to FIGS. 5 and 6, after the video data writing is performed sequentially on the subpixel rows R(n+1), R(n+2), R(n+3), and R(n+4), the fake data voltage Vfake may be supplied simultaneously to subpixel rows, disposed ahead of the subpixel row R(n+1), and the emission periods EP of which have already passed.

Subsequently, after the video data writing is performed sequentially on the subpixel rows R(n+5), R(n+6), R(n+7), and R(n+8), the fake data voltage Vfake may be supplied simultaneously to a plurality of subpixel rows, disposed ahead of the subpixel row R(n+5), and a length of emission period EP of which has passed already.

Here, a period in which the fake data insertion driving is performed is referred to as a "fake data insertion period (FDIP)," while a period in which the fake image is displayed by the fake data insertion driving is referred to as a "fake image period (FIP)."

In addition, the number k of subpixel rows, on which the fake data insertion driving is performed simultaneously, may be the same or different. In an example, two subpixel rows may be simultaneously subjected to the fake data insertion driving, and then four subpixel rows may be simultaneously subjected to the fake data insertion driving. In another example, four subpixel rows may be simultaneously subjected to the fake data insertion driving, and then eight subpixel rows may be simultaneously subjected to the fake data insertion driving.

Since both the real data and the fake data are displayed in the same frame due to the above-described fake data insertion driving, motion blurring, in which an image is blurred instead of being clearly distinguishable, can be prevented, thereby improving image quality.

In the fake data insertion driving as described above, the video data writing and the fake data writing may be performed through the data lines DL.

In addition, since the fake data writing may be performed simultaneously on the plurality of lines (e.g., subpixel rows) as described above, luminance differences due to different lengths of the emission period EP depending on line position can be compensate for, so that a video data writing time can be obtained.

In addition, the lengths of the emission period EP depending on the line position may be adaptively adjusted by adjusting the timing of the fake data insertion driving.

The video data writing timing and the fake data writing timing may be varied by controlling the gate driving.

In addition, in the fake data insertion driving, the "fake data voltage Vfake," supplied to the subpixels SP, may be, for example, a "black data voltage Vblk."

In this case, the fake data insertion driving may be referred to as "black data insertion (BDI) driving." The fake data writing in the fake data insertion driving may be referred to as black data writing. In addition, the "fake data insertion period FDIP" may also be referred to as a "BDI period BDIP." In addition, the fake image period FIP may also be referred to as a "black image period" or a "non-emission period."

The gate driving to each of the plurality of subpixel rows . . . , R(n+1), R(n+2), R(n+3), R(n+4), R(n+5), and . . . may be performed sequentially to overlap for predetermined lengths of time.

According to the illustration of FIG. 6, turn-on level periods of scanning signals (e.g., SCAN1 and SCAN2 in the case of the 3T1C structure illustrated in FIG. 3), supplied to the plurality of subpixel rows . . . , R(n+1), R(n+2), R(n+3), R(n+4), R(n+5), and . . . , respectively, are 2H. A "turn-on level", as referred to herein, may refer to a level (or amplitude) of the scanning signals that causes the subpixels of a respective subpixel row to turn on. A "turn-on level period", as referred to herein, may refer to a period of time that the subpixels of a respective subpixel row are turned on. In addition, the turn-on level periods of the scanning signals (e.g., SCAN1 and SCAN2 in the case of the 3T1C structure illustrated in FIG. 3), supplied to the plurality of subpixel rows . . . , R(n+1), R(n+2), R(n+3), R(n+4), R(n+5), and . . . , respectively, may overlap each other.

In other words, all of the turn-on level periods of the scanning signals (e.g., SCAN1 and SCAN2 in the case of the 3T1C structure illustrated in FIG. 3), supplied to the plurality of subpixel rows . . . , R(n+1), R(n+2), R(n+3), R(n+4), R(n+5), and . . . , respectively, may be 2H.

In addition, the turn-on level periods 2H of the first scanning signal SCAN1 and the second scanning signal SCAN2, applied to the first transistor T1 and the second transistor T2 of the subpixels SP arrayed in the subpixel row R(n+1), may overlap the turn-on level periods 2H of the first scanning signal SCAN1 and the second scanning signal SCAN2, applied to the first transistor T1 and the second transistor T2 of the subpixels SP arrayed in the subpixel row R(n+2), by 1H.

The turn-on level periods 2H of the first scanning signal SCAN1 and the second scanning signal SCAN2, applied to the first transistor T1 and the second transistor T2 of the subpixels SP arrayed in the subpixel row R(n+2), may overlap the turn-on level periods 2H of the first scanning signal SCAN1 and the second scanning signal SCAN2, applied to the first transistor T1 and the second transistor T2 of the subpixels SP arrayed in the subpixel row R(n+3), by 1H.

The turn-on level periods 2H of the first scanning signal SCAN1 and the second scanning signal SCAN2, applied to the first transistor T1 and the second transistor T2 of the subpixels SP arrayed in the subpixel row R(n+3), may overlap the turn-on level periods 2H of the first scanning signal SCAN1 and the second scanning signal SCAN2, applied to the first transistor T1 and the second transistor T2 of the subpixels SP arrayed in the subpixel row R(n+4), by 1H.

According to the illustration of FIG. 6, the turn-on level periods of the scanning signals SCAN1 and SCAN2 in the subpixel rows are 2H, and the turn-on level periods of the scanning signals SCAN1 and SCAN2 in two adjacent subpixel rows may overlap by 1H.

This type of gate driving is referred to as overlap driving. When the length of the turn-on level periods of the scanning signals SCAN1 and SCAN2 in each of the subpixel rows is 2H as illustrated in FIG. 6, the gate driving at this time is referred to as "2H overlap driving."

The overlap driving may be modified to have a variety of forms, other than the 2H overlap driving.

In another example of the overlap driving, the turn-on level periods of the scanning signals SCAN1 and SCAN2 in each subpixel row may be 3H, and the turn-on level periods of the scanning signals SCAN1 and SCAN2 in two adjacent subpixel rows may overlap by 2H.

In another example of the overlap driving, the turn-on level periods of the scanning signals SCAN1 and SCAN2 in each subpixel row may be 3H, and the turn-on level periods of the scanning signals SCAN1 and SCAN2 in two adjacent subpixel rows may overlap by 1H.

In another example of the overlap driving, the turn-on level periods of the scanning signals SCAN1 and SCAN2 in each subpixel row may be 4H, and the turn-on level periods of the scanning signals SCAN1 and SCAN2 in two adjacent subpixel rows may overlap by 3H.

Although a variety of overlap driving methods are possible, the 2H overlap driving will mainly be described hereinafter by way of example, for the sake of brevity.

In the 2H overlap driving as described above, the front portion (i.e., a length 1H) of the turn-on level period (i.e., a length 2H) of the scanning signal SCAN1/SCAN2 in each subpixel row is a scanning signal portion for pre-charge (PC) driving in which the data voltage (i.e., a pre-charge data voltage) is applied to the corresponding subpixels. Thus, performing pre-charge driving may refer to the application of a pre-charge data voltage. The rear portion (i.e., a length 1H) of the turn-on level period of the scanning signal SCAN1/SCAN2 in each subpixel row is a scanning signal portion, by which the video data writing is performed to apply the real video data voltage Vdata to the corresponding subpixel.

The overlap driving as described above can improve the state of charge in each subpixel, thereby improving image quality.

When the fake data insertion driving and the 2H overlap driving are performed simultaneously, the turn-on level periods of the first and second scanning signals SCAN1 and SCAN2 in the subpixel row R(n+3) overlap the turn-on level periods of the first and second scanning signals SCAN1 and SCAN2 in the subpixel row R(n+4).

Here, the rear 1H portion of the turn-on level period of the first and second scanning signals SCAN1 and SCAN2 in the subpixel row R(n+3) is a period overlapping the turn-on level period of the first and second scanning signals SCAN1 and SCAN2 in the next subpixel row R(n+4). The rear portion of the subpixel row R(n+3) is a period in which the video data writing is performed on the subpixel row R(n+3). The front 1H portion of the turn-on level period of the first and second scanning signals SCAN1 and SCAN2 in the subpixel row R(n+4) is a pre-charge driving period. In addition, the subpixel row R(n+3) and the subpixel row R(n+4) are subpixel rows in which the video data writing is performed before the fake data insertion driving proceeds.

In addition, the turn-on level period of the first and second scanning signals SCAN1 and SCAN2 in the subpixel row R(n+5) overlaps the turn-on level period of the first and second scanning signals SCAN1 and SCAN2 in the subpixel row R(n+6).

Here, the rear 1H portion of the turn-on level period of the first and second scanning signals SCAN1 and SCAN2 in the subpixel row R(n+5) is a period overlapping the turn-on level period of the first and second scanning signals SCAN1 and SCAN2 in the subpixel row R(n+6). In this period, the video data writing is performed on the subpixel row R(n+5). The front 1H portion of the turn-on level period of the first and second scanning signals SCAN1 and SCAN2 in the subpixel row R(n+6) is a pre-charge period. In addition, the subpixel row R(n+5) and the subpixel row R(n+6) are rows in which the video data writing is performed after the fake data insertion driving proceeds.

However, the turn-on level period of the first and second scanning signals SCAN1 and SCAN2 in the subpixel row R(n+4) does not overlap the turn-on level period of the first and second scanning signals SCAN1 and SCAN2 in the next subpixel row R(n+5).

The rear 1H portion of the turn-on level period of the first and second scanning signals SCAN1 and SCAN2 in the subpixel row R(n+4) is a period in which the video data writing is performed on the subpixel row R(n+4).

Pre-charge driving is not performed on the next subpixel row R(n+5) during the rear 1H portion of the turn-on level period of the first and second scanning signals SCAN1 and SCAN2 in the subpixel row R(n+4).

On the basis of the fake data insertion period FDIP, the subpixel row R(n+4) is a subpixel row in which the video data writing is performed, directly before the fake data insertion driving, and the subpixel row R(n+5) is a subpixel row in which the video data writing is performed, directly after the fake data insertion driving.

The turn-on level period of the first and second scanning signals SCAN1 and SCAN2 in the subpixel row R(n+4) and the turn-on level period of the first and second scanning signals SCAN1 and SCAN2 in the next subpixel row R(n+5) are separated by a period corresponding to the fake data insertion period FDIP.

In FIG. 6, graph Vg illustrates all voltages of the first nodes N1 of the driving transistors Td in the subpixels included in the subpixel rows, represents changes in the voltage state before entering the boosting step in the subpixel driving operation. Graph Vs illustrates all voltages of the second nodes N2 of the driving transistors Td in the subpixels included in the subpixel rows, represents changes in the voltage state before entering the boosting step in the subpixel driving operation.

Referring to graph Vg in FIG. 6, in the remaining period except for the fake data insertion period FDIP, a voltage Vg of the first node N1 of the driving transistor Td in each subpixel of each subpixel row is converted into a video data voltage Vdata, in response to the process of the video data writing.

However, during the fake data insertion period FDIP, the voltage Vg of the first node N1 of the driving transistor Td in each of the subpixels in the subpixel rows, subjected to the fake data insertion driving, becomes the fake data voltage Vfake.

In addition, as described above, the rear portion of the turn-on level period of the first and second scanning signals SCAN1 and SCAN2 in each of the subpixel rows R(n+1), R(n+2), and R(n+3) overlaps the front portion of the turn-on level period of the first and second scanning signals SCAN1 and SCAN2 in the next subpixel row. However, the rear portion of the turn-on level period of the first and second scanning signals SCAN1 and SCAN2 in the subpixel row R(n+4) does not overlap the front portion of the turn-on level period of the first and second scanning signals SCAN1 and SCAN2 in the next subpixel row R(n+5).

Thus, during the turn-on level period of the first and second scanning signals SCAN1 and SCAN2 in each of the subpixel rows R(n+1), R(n+2), and R(n+3), a voltage Vs of the second node N2 of the driving transistor Td of each of the subpixels included in the subpixel rows R(n+1), R(n+2), and R(n+3) are a voltage Vref+ΔV similar to the reference voltage Vref in the video data writing step. Here, the potential difference Vgs between the first node N1 and the second node N2 of each driving transistor Td is Vdata-(Vref+ΔV).

During the 1H period directly before the fake data insertion period FDIP, i.e., the rear portion of the turn-on level period of the first and second scanning signals SCAN1 and SCAN2 in the subpixel row R(n+4) (that does not overlap the front portion of the turn-on level period of the first and second scanning signals SCAN1 and SCAN2 in the next subpixel row R(n+5)), the voltage Vs of the second node N2 of the driving transistor Td of each subpixel included in the subpixel row R(n+4) may be Vref+Δ(V/2) lower than Vref+ΔV. Thus, the potential difference Vgs (Vgs(4)) between the first node N1 and the second node N2 of each driving transistor Td is Vdata−(Vref+Δ(V/2), increased from that of the previous period.

Since the potential difference Vgs (Vgs(4)) between the first node N1 and the second node N2 of the driving transistor Td in each of the subpixel rows R(n+4) and R(n+8), on which the video data writing is performed, directly before the fake data insertion period FDIP, increases as described above, bright stripes 700 (i.e., an abnormal screen image) may periodically appear in the subpixel rows R(n+4) and R(n+8), on which the video data writing is performed, directly before the fake data insertion period FDIP, as described above.

Accordingly, the following description will be provided of a configuration and a driving method able to prevent the periodic appearance of the bright stripes 700 (i.e., an abnormal screen image) in an active area, i.e., a display area, of the display panel 110 during the fake data insertion driving.

Figure 8:
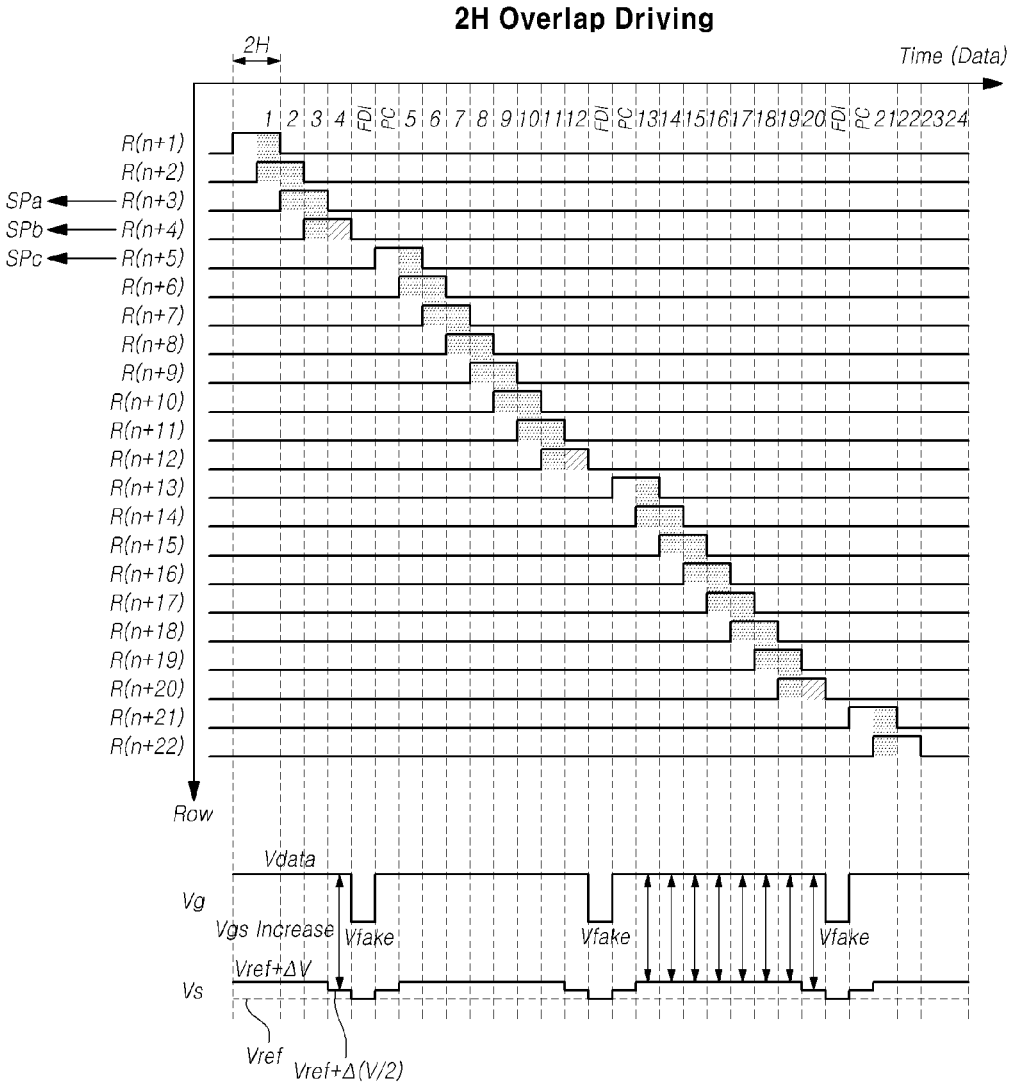
FIGS. 8 to 10 illustrate the 2H overlap driving and the fake data insertion driving in the display device according to exemplary embodiments.
Figure 9:
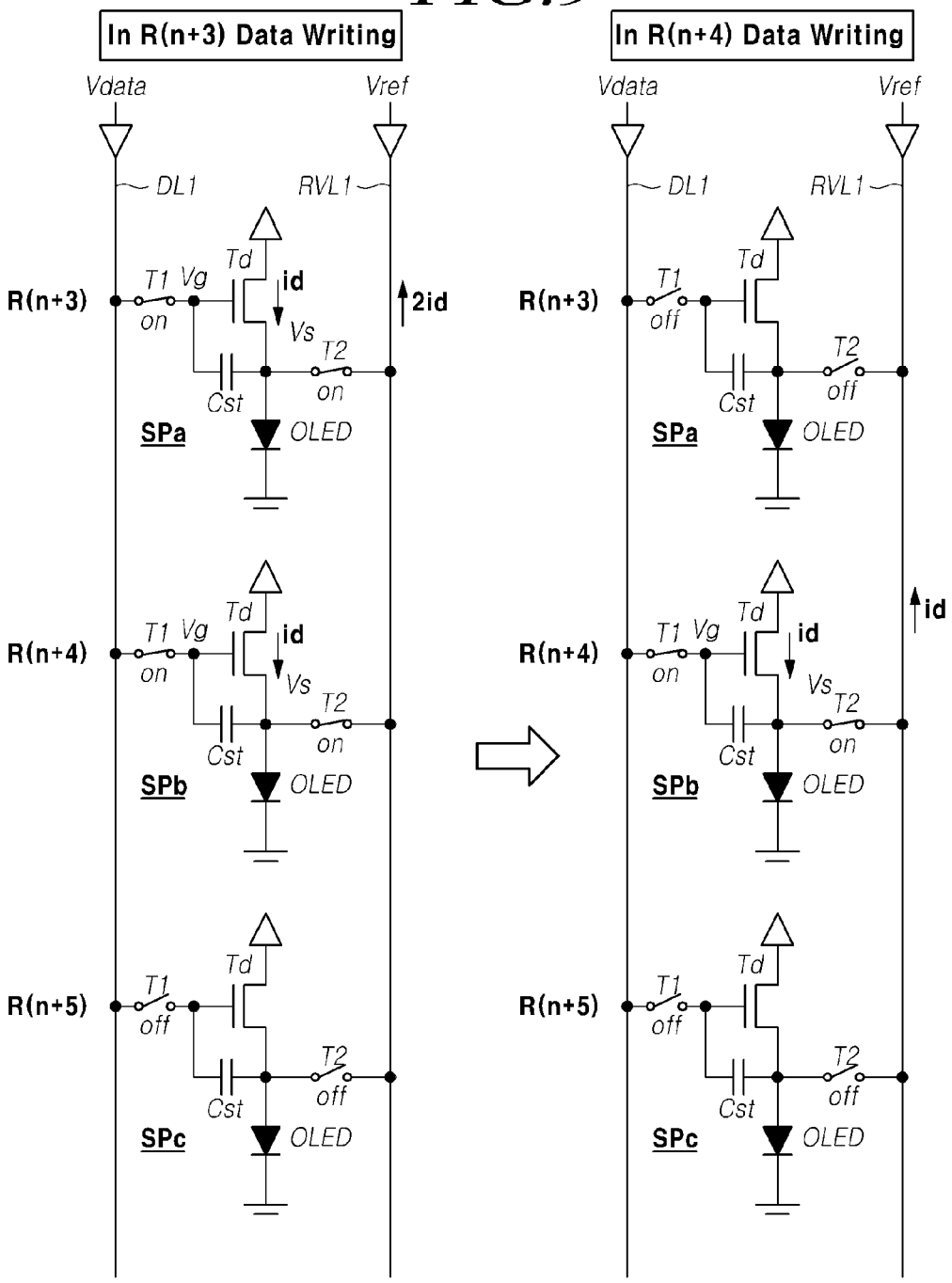
Figure 10:
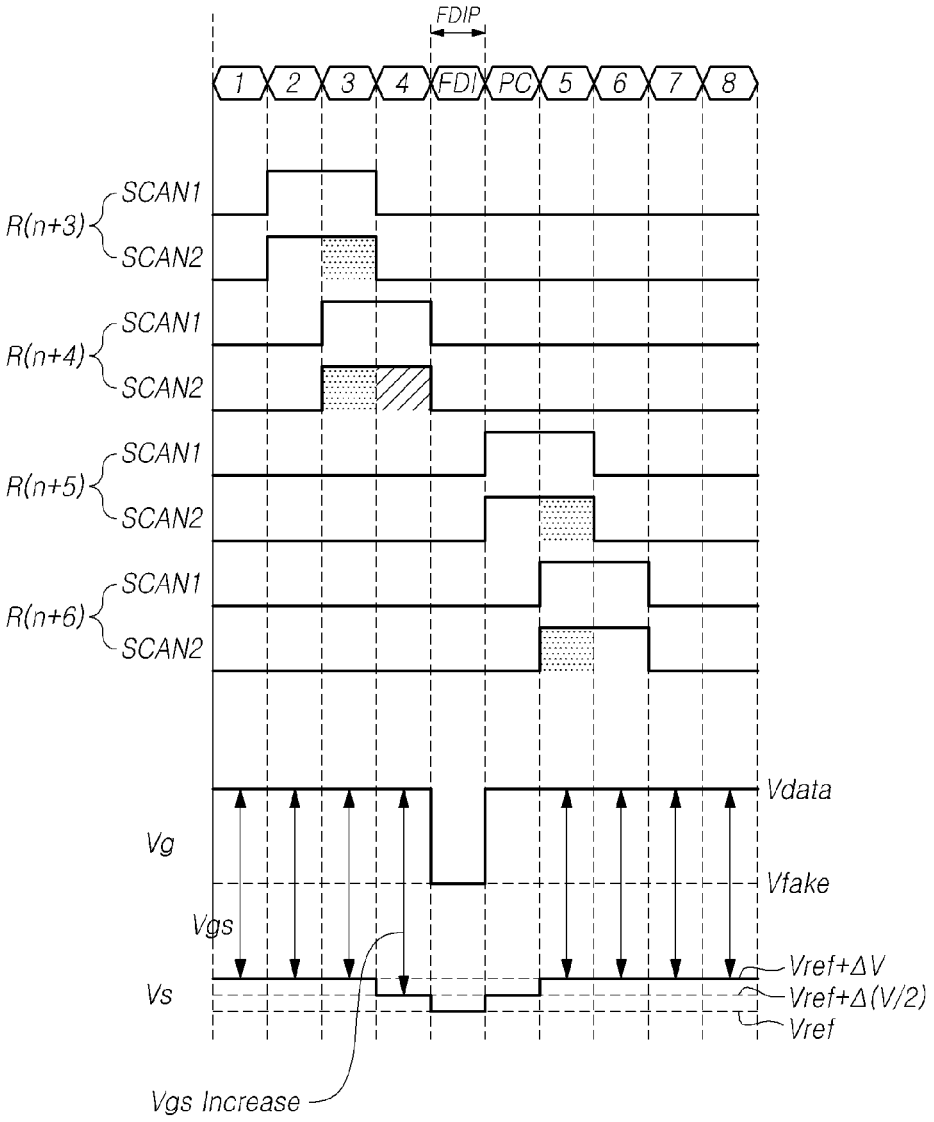

FIGS. 8 to 10 illustrate the 2H overlap driving and the fake data insertion driving in the display device 100 according to exemplary embodiments. In the following description, a case in which the subpixels SP have a 3T1C structure and the first scanning signal SCAN1 and the second scanning signal SCAN2 are the same scanning signals will be taken by way of example.

FIG. 8 illustrates scanning signals SCAN1 and SCAN2 supplied to the subpixels of twenty two (22) subpixel rows R(n+1) to R(n+22), as well as voltages Vg and Vs of the driving transistor Td in each of the subpixels of the 22 subpixel rows R(n+1) to R(n+22), in the 2H overlap driving and the fake data insertion driving.

Referring to FIG. 8, a scanning signal having a turn-on level period of 2H is supplied to each subpixel row of the 22 subpixel rows R(n+1) to R(n+22).

For example, the turn-on level period of each subpixel row of the 22 subpixel rows R(n+1) to R(n+22) has a length 2H. The turn-on level period 2H is comprised of a front portion 1H and a rear portion 1H. The front portion of the turn-on level period of each scanning signal is a scanning signal portion for pre-charging, while the rear portion of the turn-on level period of each scanning signal is a scanning signal portion for video data writing.

Due to the 2H overlap driving, the front portion (i.e., pre-charge period) of the turn-on level period of each scanning signal overlaps the rear portion (i.e., video data writing period) of the turn-on level period of a scanning signal supplied to the previous subpixel row. The rear portion (i.e., video data writing period) of the turn-on level period of each scanning signal overlaps the front portion (i.e., pre-charge period) of the turn-on level period of a scanning signal supplied to the next subpixel row.

However, directly before the fake data insertion, the rear portion (i.e., video data writing period) of the turn-on level period of the scanning signal supplied to each of the subpixel rows R(n+4), R(n+12), and R(n+20) does not overlap the front portion (i.e., pre-charge period) of the turn-on level period of the scanning signal supplied to each of the next subpixel rows R(n+5), R(n+13), and R(n+21).

Thus, directly before the fake data insertion, during the rear portion (i.e., video data writing period) of the turn-on level period of the scanning signal supplied to each of the subpixel rows R(n+4), R(n+12), and R(n+20), on which the video data writing is performed, the voltage Vs of the driving transistor Td is lowered from Vref+ΔV to Vref+Δ(V/2).

Here, the voltage Vg of the driving transistor Td before the fake data insertion is the video data voltage Vdata, while the voltage Vg of the driving transistor Td in the case of the fake data insertion is the fake data voltage Vfake.

In the subpixel rows R(n+4), R(n+12), and R(n+20), on which the video data writing is performed directly before the fake data insertion, the voltage Vgs of the driving transistor Td suddenly increases during the rear portion of the turn-on level period of the scanning signal.

Accordingly, the bright stripes 700 may occur in the subpixel rows R(n+4), R(n+12), and R(n+20), on which the video data writing is performed directly before the fake data insertion.

This will be described in more detail with reference to FIGS. 9 and 10.

FIG. 9 illustrates driving operations on a first subpixel SPa disposed in the subpixel row R(n+3), a second subpixel SPb disposed in the subpixel row R(n+4), and a third subpixel SPc disposed in the subpixel row R(n+5).

Referring to FIG. 9, the first subpixel SPa disposed in the subpixel row

R(n+3), the second subpixel SPb disposed in the subpixel row R(n+4), and the third subpixel SPc disposed in the subpixel row R(n+5) are disposed in the same column, and are electrically connected to a single first data line DL1 and a single first reference voltage line RVL1.

That is, the drain node or the source node of the first transistor T1, disposed in each of the first subpixel SPa, the second subpixel SPb, and the third subpixel SPc, may be electrically connected, in common, to the first data line DL1. The drain node or the source node of the second transistor T2, disposed in each of the first subpixel SPa, the second subpixel SPb, and the third subpixel SPc, may be electrically connected, in common, to the first reference voltage line RVL1.

Referring to FIGS. 8 to 10, in the video data writing performed on the first subpixel SPa disposed in the subpixel row R(n+3), the first transistor T1 in the first subpixel SPa in the subpixel row R(n+3) is turned on by the first scanning signal SCAN1 having a turn-on level. Consequently, the video data voltage Vdata, supplied to the first data line DL1, is transferred to the first node N1, corresponding to the gate node of the driving transistor Td.

At this time, the second transistor T2 in the first subpixel SPa in the subpixel row R(n+3) is turned on by the second scanning signal SCAN2 having a turn-on level, so that the reference voltage Vref, supplied to the first reference voltage line RVL1, is transferred to the second node N2, corresponding to the source node of the driving transistor Td, via the turned-on second transistor T2.

Due to the 2H overlap driving, during the video data writing on the first subpixel SPa in the subpixel row R(n+3), the pre-charge driving may be performed on the second subpixel SPb in the next subpixel row R(n+4).

That is, in the video data writing on the first subpixel SPa in the subpixel row R(n+3), the first scanning signal SCAN1 having a turn-on level is applied to the second subpixel SPb in the next subpixel row R(n+4), so that the video data voltage Vdata, supplied to the first data line DL1, is applied, as a pre-charge voltage, to the first node N1, i.e., the gate node of the driving transistor Td in the second subpixel SPb, via the turned-on first transistor T1.

At this time, the second transistor T2 in the second subpixel SPb in the subpixel row R(n+4) is turned on by the second scanning signal SCAN2 having a turn-on level, so that the reference voltage Vref, supplied to the first reference voltage line RVL1, is transferred to the second node N2, corresponding to the source node of the driving transistor Td, via the turned-on second transistor T2.

In the video data writing performed on the first subpixel SPa in the subpixel row R(n+3), a current 2*id*, produced by combining a current id supplied from the first subpixel SPa and a current id supplied from the second subpixel SPb, flows through the first reference voltage line RVL1. This consequently increases the voltage Vs of the driving transistor Td in the first subpixel SPa in the subpixel row R(n+3).

After the video data writing performed on the first subpixel SPa in the subpixel row R(n+3), the video data writing may be performed on the second subpixel SPb in the subpixel row R(n+4).

When the video data writing is being performed on the second subpixel SPb in the subpixel row R(n+4), the first transistor T1 in the second subpixel SPb in the subpixel row R(n+4) is turned on by the first scanning signal SCAN1 having a turn-on level. Consequently, the video data voltage Vdata, supplied to the first data line DL1, is transferred to the first node N1, corresponding to the gate node of the driving transistor Td, via the turned-on first transistor T1.

At this time, the second transistor T2 in the second subpixel SPb in the subpixel row R(n+4) is turned on by the second scanning signal SCAN2 having a turn-on level, so that the reference voltage Vref, supplied to the first reference voltage line RVL1, is transferred to the second node N2, corresponding to the source node of the driving transistor Td, via the turned-on second transistor T2.

Since the period, in which the video data writing is performed on the second subpixel SPb in the subpixel row R(n+4), is directly before the process of the fake data insertion driving, the pre-charge driving is not performed on the third subpixel SPc in the next subpixel row R(n+5) while the video data writing is being performed on the second subpixel SPb in the subpixel row R(n+4).

Consequently, in the video data writing on the second subpixel SPb in the subpixel row R(n+4), the current id, supplied from the second subpixel SPb, flows through the first reference voltage line RVL1. This consequently increases the voltage Vs of the driving transistor Td in the first subpixel SPa in the subpixel row R(n+3). However, such an increase in the voltage Vs when the video data writing is performed on the second subpixel SPb in the subpixel row R(n+4) is smaller than an increase in the voltage Vs when the video data writing is performed on the first subpixel SPa in the subpixel row R(n+3).

Accordingly, directly before the fake data voltage Vfake is applied to the first data line DL1 due to the fake data insertion driving (i.e., directly before the fake data insertion period FDIP), the voltage Vgs increases while the video data writing is being performed on the second subpixel SPb in the subpixel row R(n+4).

Such an increase in the voltage Vgs may be expressed with the bright stripes 700 in the subpixel rows R(n+4), R(n+12), and R(n+20), on which the video data writing is performed, directly before the fake data insertion. A driving method for preventing such a phenomenon will be described with reference to FIGS. 11 to 12 by way of example.

Figure 11:
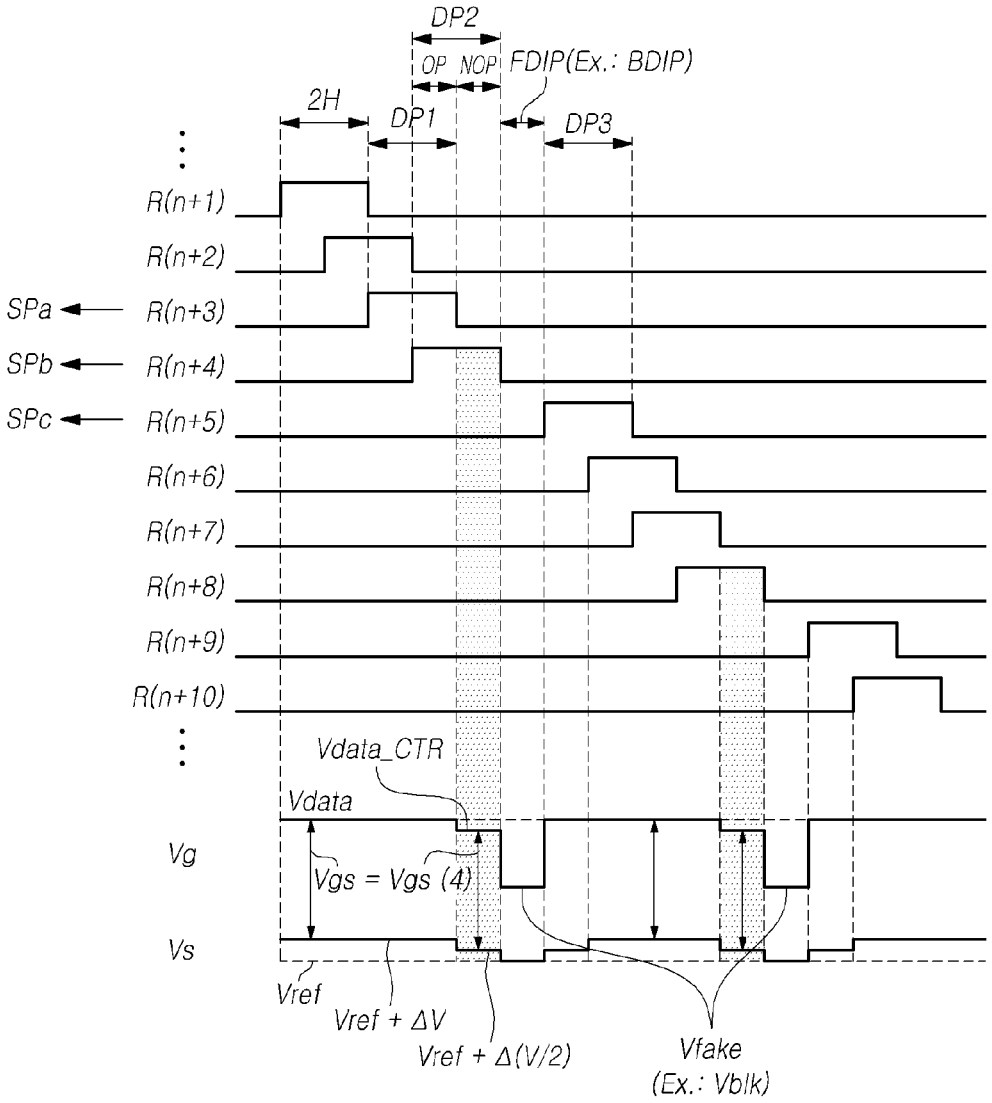
FIGS. 11 and 12 are driving timing diagrams illustrating data control for preventing an abnormal screen image due to the 2H overlap driving and the fake data insertion driving in the display device according to exemplary embodiments.
Figure 12:
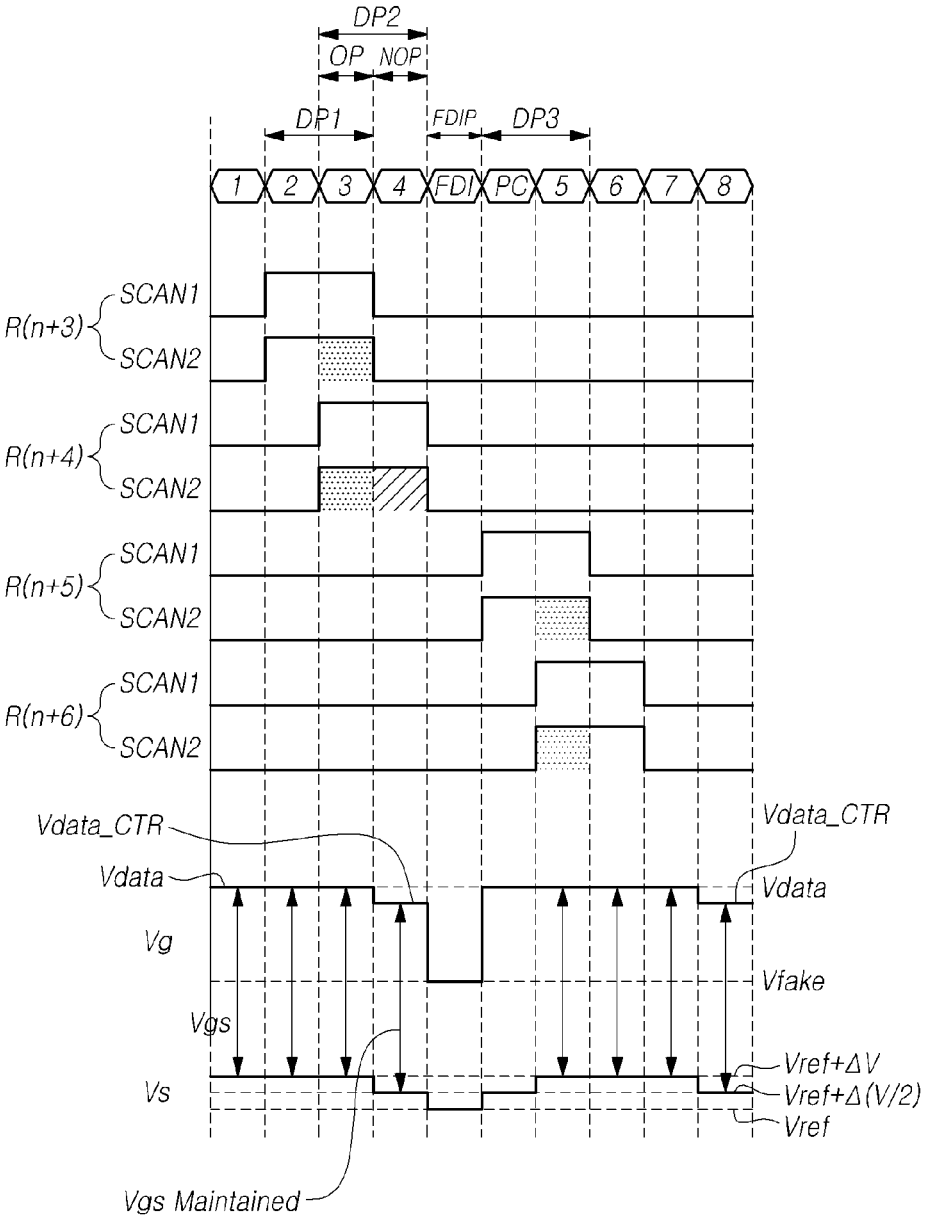

FIGS. 11 and 12 are driving timing diagrams illustrating data control for preventing an abnormal screen image due to the 2H overlap driving and the fake data insertion (FDI) driving in the display device 100 according to exemplary embodiments.

Referring to FIGS. 11 and 12, the data voltage Vdata may be sequentially supplied to the first subpixel SPa, the second subpixel SPb, and the third subpixel SPc among the plurality of subpixels SP, via the first data line DL1.

Due to the overlap driving (e.g., 2*h* overlap driving), a first driving period DP1, in which a scanning signal having a turn-on level is supplied to the first subpixel SPa, may overlap a second driving period DP2, in which the scanning signal having the turn-on level is supplied to the second subpixel SPb.

However, due to the fake data insertion driving, the second driving period DP2, in which the scanning signal having the turn-on level is supplied to the second subpixel SPb, may not overlap a third driving period DP3, in which the scanning signal having the turn-on level is supplied to the third subpixel SPc.

Due to the fake data insertion driving, during the fake data insertion period FDIP corresponding to the period between the second driving period DP2 and the third driving period DP3, the fake data voltage Vfake, different from the video data voltage Vdata, may be supplied to the first data line DL1.

Due to the fake data insertion driving, a fake image, different from real images, may be displayed in an active period, within a one-frame period, which is not a blank period. The active period, in which the fake image is displayed, may be referred to as the fake image period.

The second driving period DP2 may include an overlapping period OP overlapping the first driving period DP1 and a non-overlapping period NOP, not overlapping the first driving period DP1. The non-overlapping period NOP of the second driving period DP2 may not overlap the third driving period DP3.

A video data voltage Vdata_CTR, supplied to the second subpixel SPb during the non-overlapping period NOP of the second driving period DP2, may be lower than the video data voltage Vdata, supplied to the second subpixel SPb during the overlapping period OP.

The term "second driving period DP2" used herein refers to a driving period directly before the fake data insertion period FDIP.

Referring to FIGS. 11 and 12, the fake data voltage Vfake, supplied to the first data line DL1, may correspond to, for example, the black data voltage Vblk. For example, the black data voltage Vblk may have a low voltage of 0V or a voltage close to 0V. The black data voltage Vblk may be a data voltage, by which the corresponding second subpixel SPb displays black. In some cases, the black data voltage Vblk may be a data voltage, by which the corresponding second subpixel SPb displays a color similar to pure black or the corresponding second subpixel SPb does not emit light.

The fake data voltage Vfake, supplied to the first data line DL1, is simultaneously supplied to two or more subpixels SP via the first data line DL1. The two or more subpixels SP may be supplied with the video data voltage Vdata before the first subpixel SPa.

The fake data voltage Vfake may be a voltage different from the video data voltage Vdata supplied to the two or more subpixels SP.

The fake data voltage Vfake, supplied to the first data line DL1, may be simultaneously supplied to the two or more subpixels SP, which are already emitting light. At this time, the two or more subpixels SP may stop emitting light, in response to the fake data voltage Vfake being transferred thereto.

Each of the first subpixel SPa, the second subpixel SPb, and the third subpixel SPc may have the structure illustrated in FIG. 2 or 3.

Each of the first subpixel SPa, the second subpixel SPb, and the third subpixel SPc, having the structure illustrated in FIG. 3, may include the organic light-emitting diode OLED, the driving transistor Td driving the organic light-emitting diode OLED, the first transistor T1 electrically connected between the first node N1 of the driving transistor Td and the first data line DL1, the second transistor T2 electrically connected between the second node N2 of the driving transistor Td and the first reference voltage line RVL1, and the storage capacitor Cst electrically connected between the first node N1 of the driving transistor Td and the second node N2.

A voltage of the first node N1 of the driving transistor Td in the second subpixel SPb during the non-overlapping period NOP of the second driving period DP2 (i.e., a voltage corresponding to Vdata_CTR transferred via the first transistor T1) may be lower than a voltage of the first node N1 of the driving transistor Td in the second subpixel SPb during the overlapping period OP of the second driving period DP2 (i.e., a voltage corresponding to Vdata transferred via the first transistor T1).

A voltage of the second node N2 of the driving transistor Td in the second subpixel SPb during the non-overlapping period NOP of the second driving period DP2 (i.e., the voltage Vref+Δ(V/2) or a voltage corresponding thereto) may be lower than a voltage of the second node N2 of the driving transistor Td in the second subpixel SPb during the overlapping period OP of the second driving period DP2 (i.e., the voltage Vref+ΔV or a voltage corresponding thereto).

The voltage difference "Vgs=Vdata_CTR−(Vref+Δ(V/2)" between the first node N1 and the second node N2 of the driving transistor Td in the second subpixel SPb during the non-overlapping period NOP of the second driving period DP2 may correspond to the voltage difference "Vgs=Vdata−(Vref+ΔV)" between the first node N1 and the second node N2 of the driving transistor Td in the second subpixel SPb during the overlapping period OP of the second driving period DP2.

That is, a reduction "Vdata−Vdata_CTR" in the voltage of the first node N1 of the driving transistor Td in the second subpixel SPb during the second driving period DP2, may correspond to a reduction A(V/2) in the voltage of the second node N2 of the driving transistor Td during the second driving period DP2.

Referring to FIG. 12, the first driving period DP1 may be the turn-on level period of the first scanning signal SCAN1 applied to the gate node of the first transistor T1 in the first subpixel SPa. The second driving period DP2 may be the turn-on level period of the first scanning signal SCAN1 applied to the gate node of the first transistor T1 in the second subpixel SPb. The third driving period DP3 may be the turn-on level period of the first scanning signal SCAN1 applied to the gate node of the first transistor T1 in the third subpixel SPc.

The overlapping period OP and the non-overlapping period NOP of the second driving period DP2 may have the same lengths. For example, the second driving period DP2 may have a time length corresponding to two horizontal periods 2H, and the time length of each of the overlapping period OP and the non-overlapping period NOP may correspond to one horizontal period 1H.

Figure 13:
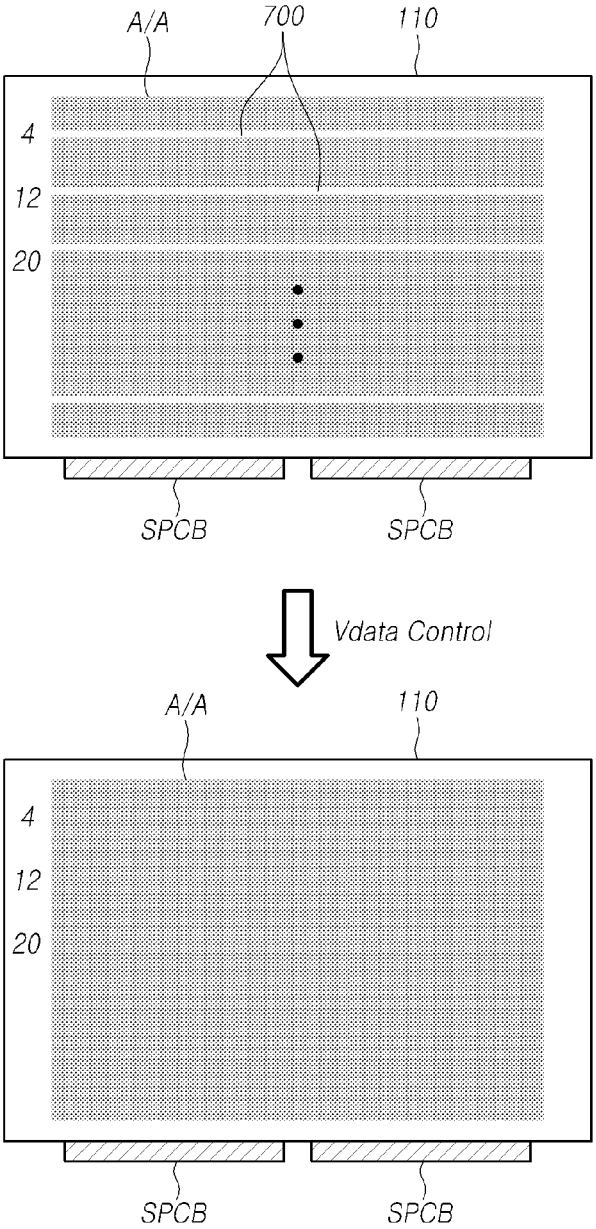
FIG. 13 illustrates the effect of the data control in the display device according to exemplary embodiments, by which an abnormal screen image caused by the 2H overlap driving and the fake data insertion driving is prevented.

FIG. 13 illustrates the effect of the data control in the display device 100 according to exemplary embodiments, by which an abnormal screen image caused by the 2H overlap driving and the fake data insertion driving is prevented.

As described above, the display device 100 according to exemplary embodiments may display the fake image, different from real images, in the fake image period, i.e., an active period within a one-frame period, which is not a blank period.

During the fake image period, the fake data voltage Vfake, corresponding to the fake image, may be supplied to the first data line DL1.

Before the fake image period, during the second driving period DP2, a scanning signal having a turn-on level may be supplied to the second subpixel SPb connected to the first data line DL1.

According to the data control as described above, during the second driving period DP2, in which the scanning signal having the turn-on level is supplied to the second subpixel SPb, the video data voltage, supplied to the second subpixel SPb, via the first data line DL1 may be varied from Vdata to Vdata_CTR.

In response to the fake data insertion driving and the 2H overlap driving, the potential difference Vgs between the first node N1 and the second node N2 of the driving transistor Td in each of the subpixel rows R(n+4), R(n+12), R(n+20), and . . . , on which the video data writing is performed, directly before the fake data insertion period FDIP, may be increased, thereby causing a periodic appearance of the bright stripes 700 (i.e., an abnormal screen image), as illustrated in FIG. 7, in the subpixel rows R(n+4), R(n+12), R(n+20), and . . . , on which the video data writing is performed, directly before the fake data insertion period FDIP.

However, according to the above-described control, the potential difference Vgs between the first node N1 and the second node N2 of the driving transistor Td can be maintained, despite of the fake data insertion driving and the 2H overlap driving, thereby preventing the abnormal screen image, i.e., the periodic appearance of the bright stripes 700.

FIGS. 14 to 17 illustrate gamma curves for individual colors for representing color-specific data control in the display device 100 according to exemplary embodiments.

Figure 14:
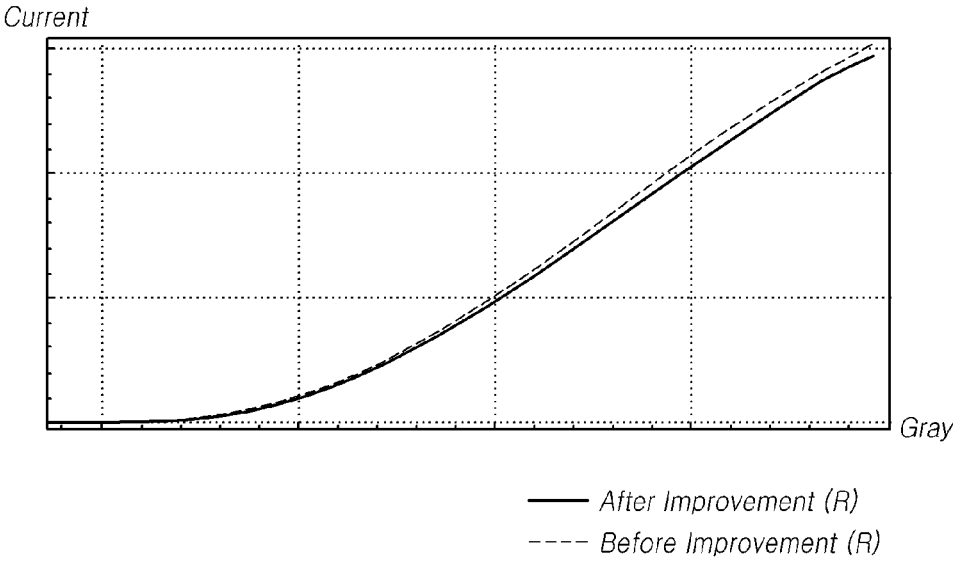
FIGS. 14 to 17 illustrate gamma curves for individual colors for representing color-specific data control in the display device according to exemplary embodiments.
Figure 15:
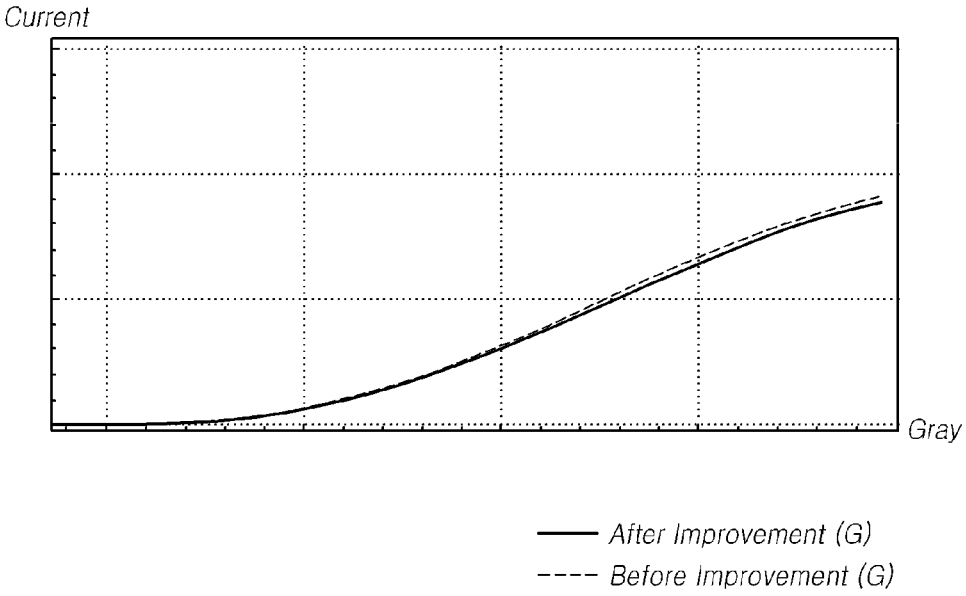
Figure 16:
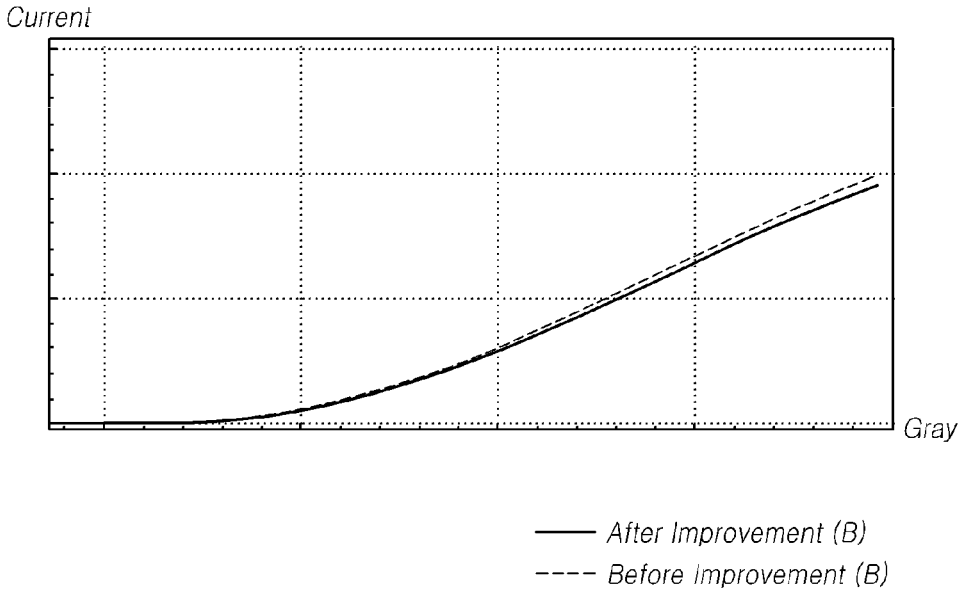
Figure 17:
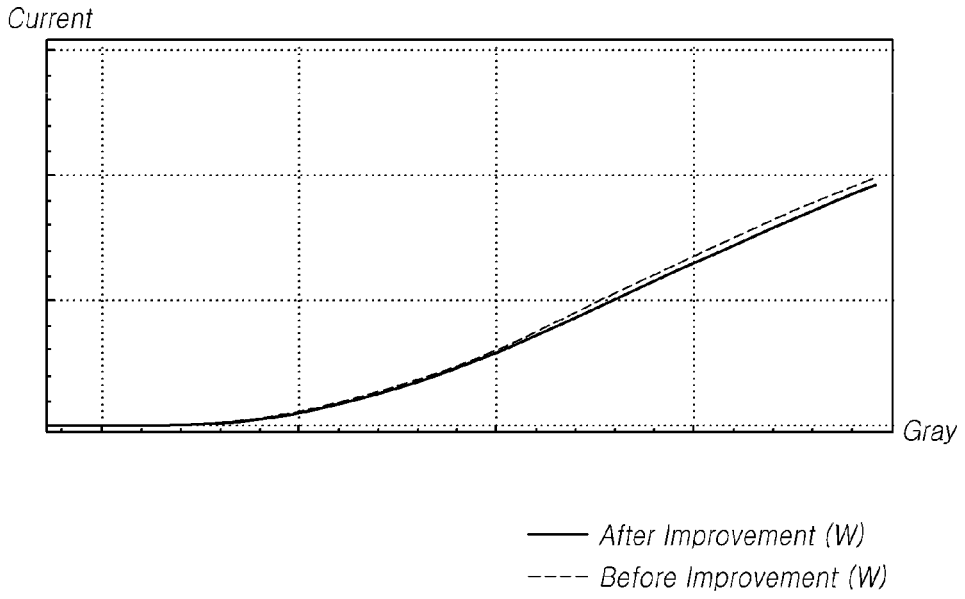

For example, FIG. 14 illustrates the gamma curve for red (R) before the application of the data control (before improvement) and after the application of the data control (after improvement). FIG. 15 illustrates the gamma curve for green (G) before the application of the data control (before improvement) and after the application of the data control (after improvement). FIG. 16 illustrates the gamma curve for blue (B) before the application of the data control (before improvement) and after the application of the data control (after improvement). FIG. 17 illustrates the gamma curve for white (W) before the application of the data control (before improvement) and after the application of the data control (after improvement).

Referring to the gamma curves for the four colors R, G, B, and W in FIGS. 14 to 17, it can be appreciated that the amount of current (current supplied to the OLED) for the same gray level (grayscale) was reduced after the application of the data control (after improvement). Accordingly, the organic light-emitting diode OLED emits light, which is not bright or is less-bright, so that none of the bright stripes 700 appear on the screen. It may be said that, the term "gray level" as referred to herein indicates the brightness of a pixel. The skilled person may calculate the gray level from the four colors R, G, B, and W using a technique known in the art.

The gamma curves for the four colors R, G, B, and W may be the same. Alternatively, as illustrated in FIGS. 14 to 17, at least one of the gamma curves for the four colors R, G, B, and W may be different from the remaining gamma curves, or all of the gamma curves for the four colors R, G, B, and W may be different from each other.

Further, with reference to FIGS. 14 to 17, during the non-overlapping period NOP of the second driving period DP2, the video data voltage Vdata_CTR, supplied to the second subpixel SPb, may vary, depending on the colors R, G, B, and W of light emitted by the second subpixel SPb.

That is, in response to switching of periods from the overlapping period OP to the non-overlapping period NOP during the second driving period DP2, the reduction "Vdata−Vdata_CTR" of the video data voltage, supplied to the second subpixel SPb, may vary, depending on the colors R, G, B, and W of light emitted by the second subpixel SPb.

Referring to FIGS. 14 to 17, during the non-overlapping period NOP of the second driving period DP2, the video data voltage Vdata_CTR, supplied to the second subpixel SPb, may vary, depending on the gray level of light emitted by the second subpixel SPb.

That is, in response to switching of periods from the overlapping period OP to the non-overlapping period NOP during the second driving period DP2, the reduction "Vdata−Vdata_CTR" of the video data voltage, supplied to the second subpixel SPb, may vary, depending on the gray level of light emitted by the second subpixel SPb.

Figure 18:
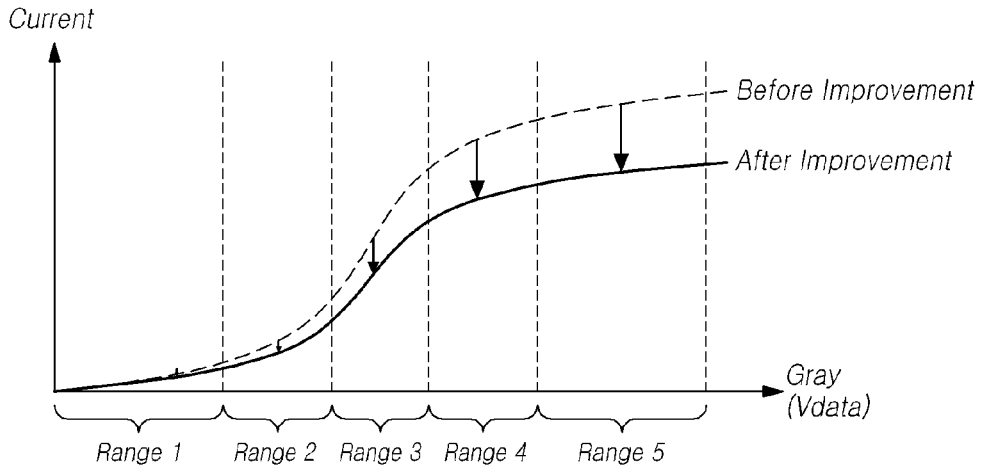
FIG. 18 illustrates gain and offset control for the color-specific data control in the display device according to exemplary embodiments.

FIG. 18 illustrates gain and offset control for the color-specific data control in the display device 100 according to exemplary embodiments, while FIG. 19 illustrates a lookup table LUT for the color-specific data control in the display device 100 according to exemplary embodiments.

In this case, the gamma curve illustrates an exemplary gamma curve for a certain color.

The display device 100 according to exemplary embodiments may include the color-specific lookup table LUT, which is referred to when changing the video data voltage Vdata supplied to the second subpixel SPb during the non-overlapping period NOP of the second driving period DP2 directly before the fake data insertion driving.

The controller 140 may change the video data to be supplied to the second subpixel SPb during the second driving period DP2 by referring to the color-specific lookup table LUT.

The color-specific lookup table LUT may include information regarding gain and offset varying in response to the change of the gray level.

Alternatively, the color-specific lookup table LUT may include information regarding gain and offset respectively corresponding to two or more gray level ranges.

A description will be provided with reference to the illustrations in FIGS. 18 and 19.

Referring to FIGS. 18 and 19, the color-specific lookup table LUT may include information regarding gain and offset respectively corresponding to five gray level ranges Range 1 to Range 5, i.e., ranges produced when the entire gray level range is divided.

A portion of the lookup table LUT, corresponding to red (R), may include gain GR1 and offset OR1 corresponding to Range 1, gain GR2 and offset OR2 corresponding to Range 2, gain GR3 and offset OR3 corresponding to Range 3, gain GR4 and offset OR4 corresponding to Range 4, and gain GR5 and offset OR5 corresponding to Range 5.

Here, the gains GR1 to GR5, corresponding to the five gray level ranges Range 1 to Range 5, may be the same. Alternatively, all of the gains GR1 to GR5, corresponding to the five gray level ranges Range 1 to Range 5, may be different from each other, or at least one of the gains GR1 to GR5 may be different from the remaining gains. The offsets OR1 to OR5, corresponding to the five gray level Range 1 to Range 5, may be the same. Alternatively, all of the offsets OR1 to OR5, corresponding to the five gray level ranges Range 1 to Range 5, may be different from each other, or at least one of the offsets OR1 to OR5 may be different from the remaining offsets.

A portion of the lookup table LUT, corresponding to green (G), may include gain GG1 and offset OG1 corresponding to Range 1, gain GG2 and offset OG2 corresponding to Range 2, gain GG3 and offset OG3 corresponding to Range 3, gain GG4 and offset OG4 corresponding to Range 4, and gain GG5 and offset OG5 corresponding to Range 5.

Here, the gains GG1 to GG5, corresponding to the five gray level ranges Range 1 to Range 5, may be the same. Alternatively, all of the gains GG1 to GG5, corresponding to the five gray level ranges Range 1 to Range 5, may be different from each other, or at least one of the gains GG1 to GG5 may be different from the remaining gains. The offsets OG1 to OG5, corresponding to the five gray level Range 1 to Range 5, may be the same. Alternatively, all of the offsets OG1 to OG5, corresponding to the five gray level ranges Range 1 to Range 5, may be different from each other, or at least one of the offsets OG1 to OG5 may be different from the remaining offsets.

A portion of the lookup table LUT, corresponding to blue (B), may include gain GB1 and offset OB1 corresponding to Range 1, gain GB2 and offset OB2 corresponding to Range 2, gain GB3 and offset OB3 corresponding to Range 3, gain GB4 and offset OB4 corresponding to Range 4, and gain GB5 and offset OB5 corresponding to Range 5.

Here, the gains GB1 to GB5, corresponding to the five gray level ranges Range 1 to Range 5, may be the same. Alternatively, all of the gains GB1 to GB5, corresponding to the five gray level ranges Range 1 to Range 5, may be different from each other, or at least one of the gains GB1 to GB5 may be different from the remaining gains. The offsets OB1 to OB5, corresponding to the five gray level Range 1 to Range 5, may be the same. Alternatively, all of the offsets OB1 to OB5, corresponding to the five gray level ranges Range 1 to Range 5, may be different from each other, or at least one of the offsets OB1 to OB5 may be different from the remaining offsets.

A portion of the lookup table LUT, corresponding to white (W), may include gain GW1 and offset OW1 corresponding to Range 1, gain GW2 and offset OW2 corresponding to Range 2, gain GW3 and offset OW3 corresponding to Range 3, gain GW4 and offset OW4 corresponding to Range 4, and gain GW5 and offset OW5 corresponding to Range 5.

Here, the gains GW1 to GW5, corresponding to the five gray level ranges Range 1 to Range 5, may be the same. Alternatively, the gains GW1 to GW5, corresponding to the five gray level ranges Range 1 to Range 5, may be different from each other, or at least one of the gains GW1 to GW5 may be different from the remaining gains. The offsets OW1 to OW5, corresponding to the five gray level ranges Range 1 to Range 5, may be the same. Alternatively, all of the offsets OW1 to OW5, corresponding to the five gray level ranges Range 1 to Range 5, may be different from each other, or at least one of the offsets OW1 to OW5 may be different from the remaining gains.

The magnitudes of the five gray level ranges Range 1 to Range 5 may be the same, or the magnitude of at least one of the five gray level ranges Range 1 to Range 5 may be different from those of the remaining gray level ranges.

Referring to the illustration in FIG. 18, among the five gray level ranges Range 1 to Range 5, the magnitudes of Range 1 and Range 5 may be the greatest, while the magnitude of Range 3 may be the smallest.

For example, the relative largeness and smallness of the magnitudes of the ranges may vary, depending on changes in current due to changes in the gray level. The magnitudes of Range 1 and Range 5 may be the greatest, due to the smallest degree of the current change, while the magnitude of Range 3 may be the smallest, due to the greatest degree of the current change.

The controller 140 may change the video data to be supplied to the second subpixel SPb during the second driving period DP2 by referring to the color-specific lookup table LUT set as described above. Accordingly, the video data voltage, output from the data driver circuit 120, may be lowered from Vdata to Vdata_CTR, as illustrated in FIG. 18.

For example, a case in which the unchanged video data is DATA, and the video data changed by the data control according to an exemplary embodiment is DATA_CTR, may be taken. In this case, the controller 140 selects a gain and an offset, corresponding to the corresponding gray level range, by referring to the lookup table LUT of the color, corresponding to the unchanged video data DATA, and changes the video data DATA, thereby generating the controlled video data DATA_CTR. If the selected gain and offset are GR1 and OR1, the controlled video data DATA_CTR is expressed by the following formula:

$$\text{DATA_}CTR = GR1 \times \text{DATA} + OR1$$

Expressing this formula in an analog voltage format output by the data driver circuit 120, in a case in which the unchanged data voltage is Vdata and the video data changed by the data control according to an exemplary embodiment is Vdata_CTR, Vdata_CTR is expressed as follows. The gain of the analog value, corresponding to the gain GR1, is expressed as gr1, and the offset of the analog value, corresponding to the offset OR1, is expressed as or1.

$$V\text{data_}CTR = gr1 \times V\text{data} + or1$$

The lookup table LUT, corresponding to the four colors R, G, B, and W, may be provided as separate tables for the four colors or may be provided as a single table.

In addition, although the lookup table LUT corresponding to the four colors R, G, B, and W was taken herein by way of example, the lookup table LUT may correspond to three colors R, G, and B in a case in which the subpixels SP emit light having three colors R, G, and B.

Hereinafter, the above-described driving method will be briefly described.

Figure 20:
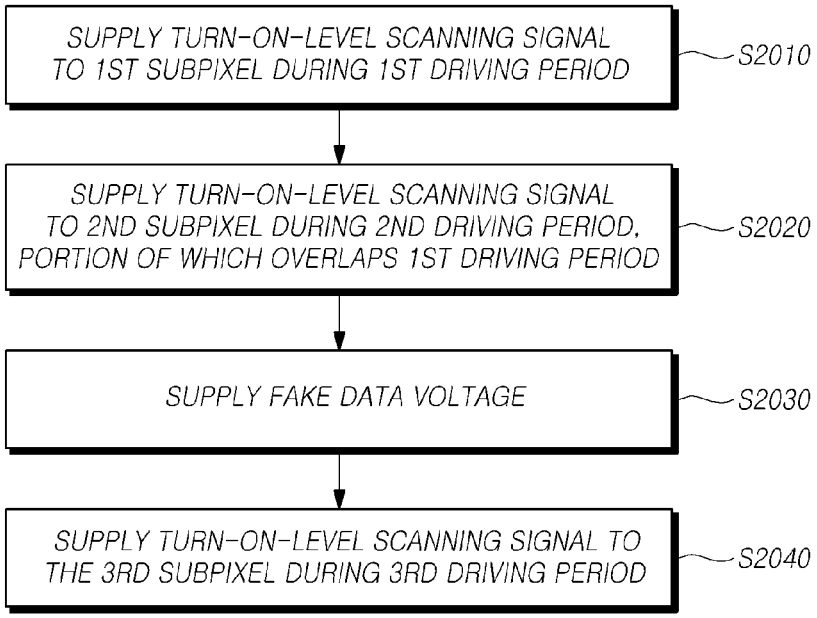
FIG. 20 is a flowchart illustrating a method of driving the display device according to exemplary embodiments.

FIG. 20 is a flowchart illustrating a method of driving the display device 100 according to exemplary embodiments.

Referring to FIG. 20, the method of driving the display device 100 according to exemplary embodiments may include: operation S2010 of supplying a scanning signal having a turn-on level to the first subpixel SPa during the first driving period DP1; operation S2020 of supplying the scanning signal having the turn-on level to the second subpixel SPb during the second driving period DP2 that has started after the start of the first driving period DP1 and before the termination of the first driving period DP1; operation S2040 of supplying the scanning signal having the turn-on level to the third subpixel SPc during the third driving period DP3 after the termination of the second driving period DP2; and the like.

Referring to FIG. 20, the method of driving the display device 100 according to exemplary embodiments may further include operation S2030 of supplying a fake data voltage Vfake, different from the video data voltage Vdata, to the first data line DL1, between operation S2020 and operation S2040.

The first driving period DP1 and the second driving period DP2 may overlap each other, while the second driving period DP2 and the third driving period DP3 may not overlap each other.

The second driving period DP2 may include the overlapping period OP overlapping the first driving period DP1 and the non-overlapping period NOP, not overlapping the first driving period DP1.

The video data voltage Vdata_CTR, supplied to the second subpixel SPb during the non-overlapping period NOP of the second driving period DP2, may be lower than the video data voltage Vdata, supplied to the second subpixel SPb during the overlapping period OP of the second driving period DP2.

The voltage Vdata_CTR of the first node N1 of the driving transistor Td in the second subpixel SPb during the non-overlapping period NOP of the second driving period DP2 may be lower than the voltage Vdata of the first node N1 of the driving transistor Td in the second subpixel SPb during the overlapping period OP of the second driving period DP2.

The voltage of the second node N2 of the driving transistor Td in the second subpixel SPb during the non-overlapping period NOP of the second driving period DP2 may be lower than the voltage of the second node N2 of the driving transistor Td in the second subpixel SPb during the overlapping period OP of the second driving period DP2.

The voltage difference between the first node N1 and the second node N2 of the driving transistor Td in the second subpixel SPb during the non-overlapping period NOP of the second driving period DP2 may correspond to the voltage difference between the first node N1 and the second node N2 of the driving transistor Td in the second subpixel SPb during the overlapping period OP of the second driving period DP2.

Figure 21:
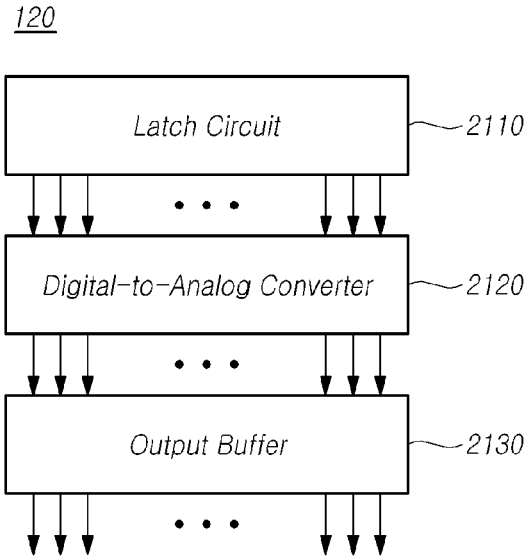
FIG. 21 is a block diagram illustrating the data driver circuit according to exemplary embodiments.

FIG. 21 is a block diagram illustrating the data driver circuit 120 according to exemplary embodiments.

Referring to FIG. 21, the data driver circuit 120 according to exemplary embodiments may include: a latch circuit 2110 storing video data received from the controller 140, a digital analog converter (DAC) 2120 converting the video data into an analog data voltage, an output buffer 2130 outputting the data voltage to the plurality of data line DL, and the like.

The output buffer 2130 may sequentially supply the video data voltage Vdata to the first subpixel SPa, the second subpixel SPb, and the third subpixel SPc, disposed in the display panel, through the first data line DL1.

In response to the 2H overlap driving, the first driving period DP1, in which the scanning signal having the turn-on level is supplied to the first subpixel SPa, may overlap the second driving period DP2, in which the scanning signal having the turn-on level is supplied to the second subpixel SPb.

In response to the fake data insertion driving, the second driving period DP2, in which the scanning signal having the turn-on level is supplied to the second subpixel SPb, may not overlap the third driving period DP3, in which the scanning signal having the turn-on level is supplied to the third subpixel SPc.

In response to the fake data insertion driving, the output buffer 2130 may output the fake data voltage Vfake, different from the video data voltage Vdata, to the first data line DL1 during the fake data insertion period FDIP corresponding to the period between the second driving period DP2 and the third driving period DP3.

According to exemplary embodiments, the second driving period DP2 may include the overlapping period OP overlapping the first driving period DP1 and the non-overlapping period NOP, not overlapping the first driving period DP1, depending on the result of the data control. The video data voltage Vdata_CTR, supplied to the second subpixel SPb, during the non-overlapping period NOP of the second driving period DP2, may be lower than the video data voltage Vdata, supplied to the second subpixel SPb during the overlapping period OP of the second driving period DP2.

Figure 22:
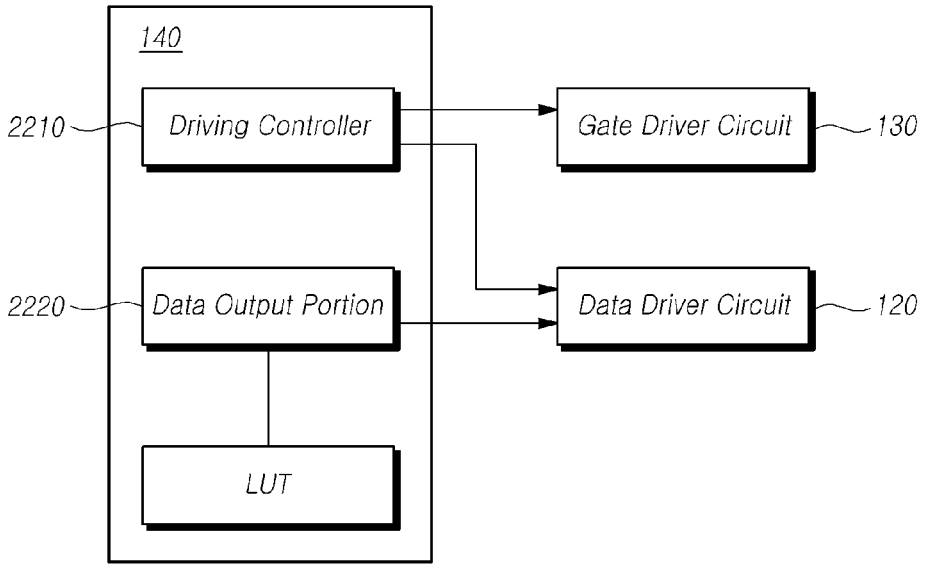
FIG. 22 is a block diagram of the controller according to exemplary embodiments.

FIG. 22 is a block diagram of the controller 140 according to exemplary embodiments.

Referring to FIG. 22, the controller 140 according to exemplary embodiments may include a driver controller 2210 controlling the data driver circuit 120 and the gate driver circuit 130 and a data output portion 2220 outputting video data to the data driver circuit 120.

The data output portion 2220 may output video data to the data driver circuit 120, the video data being supposed to be sequentially supplied to the first subpixel SPa, the second subpixel SPb, and the third subpixel SPc arrayed in the display panel.

The driver controller 2210 may control the first driving period DP1, in which a scanning signal having a turn-on level is supplied to the first subpixel SPa, and the second driving period DP2, in which the scanning signal having the turn-on level is supplied to the second subpixel SPb, to overlap each other.

The driver controller 2210 may control the second driving period DP2, in which the scanning signal having the turn-on level is supplied to the second subpixel SPb, and the third driving period DP3, in which the scanning signal having the turn-on level is supplied to the third subpixel SPc, not to overlap each other.

The data output portion 2220 may output the fake data (corresponding to the digital value of Vfake), different from the video data to be supplied to the first data line DL1, to the data driver circuit 120, during the fake data insertion period FDIP corresponding to the period between the second driving period DP2 and the third driving period DP3.

The second driving period DP2 may include the overlapping period OP overlapping the first driving period DP1 and the non-overlapping period NOP, not overlapping the first driving period DP1.

The video data (corresponding to the digital value of Vdata_CTR), output to be supplied to the second subpixel SPb during the non-overlapping period NOP of the second driving period DP2, may correspond to an analog voltage lower than the video data (corresponding to the digital value of Vdata), output to be supplied to the second subpixel SPb during the overlapping period OP of the second driving period DP2.

Referring to FIG. 22, the controller 140 according to exemplary embodiments may include the color-specific lookup table LUT for the change of the video data output to be supplied to the second subpixel SPb during the non-overlapping period NOP of the second driving period DP2.

The lookup table LUT for individual colors may include information regarding the gain and the offset changing with changes in the gray or may include information regarding the gain and the offset respectively corresponding to two or more gray ranges.

As set forth above, according to exemplary embodiments, it is possible to improve the state of charge by performing overlap driving of the subpixels, thereby improving image quality.

According to exemplary embodiments, it is possible to reduce or prevent luminance differences due to image blurring or different emission periods depending on line position by performing the fake data insertion (FDI) driving of inserting a fake image, different from real images, into every line of a plurality of lines, thereby improving image quality.

According to exemplary embodiments, it is possible to combine the overlap driving and the fake data insertion driving, thereby further improving image quality.

According to exemplary embodiments, it is possible to prevent the periodic appearance of bright stripes 700, which may be caused by combining the overlap driving and the fake data insertion driving, immediately before the insertion of the fake data, thereby further improving image quality.

The foregoing descriptions and the accompanying drawings have been presented in order to explain certain principles of the present disclosure by way of example. A person having ordinary skill in the art to which the present disclosure relates could make various modifications and variations by combining, dividing, substituting for, or changing the elements without departing from the principle of the present disclosure. The foregoing embodiments disclosed herein shall be interpreted as being illustrative, while not being limitative, of the principle and scope of the present disclosure. It should be understood that the scope of the present disclosure shall be defined by the appended Claims and all of their equivalents fall within the scope of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device comprising:

a display panel—having a plurality of subpixels, wherein the plurality of subpixels includes a first subpixel row, a second subpixel row and a third subpixel row arranged sequentially, wherein a first driving period, in which a scanning signal having a turn-on level is supplied to subpixels in the first subpixel row, and a second driving period, in which the scanning signal having the turn-on level is supplied to subpixels in the second subpixel row, overlap each other, wherein the second driving period and a third driving period, in which the scanning signal having the turn-on level is supplied to subpixels in the third subpixel row, do not overlap each other, wherein, during the first, second, and third driving periods, a video data voltage is sequentially supplied to the subpixels in the first subpixel row, the subpixels in the second subpixel row, and the subpixels in the third subpixel row, wherein, during a fake data insertion period corresponding to a period between the second driving period and the third driving period, a fake data voltage, which is different from the video data voltage, is supplied to two or more of the plurality of subpixels in the display panel, wherein the second driving period includes an overlapping period that overlaps the first driving period and a non-overlapping period that does not overlap either the first driving period or the third driving period, wherein a voltage difference between a gate node and a source node of a driving transistor electrically connected to an organic light-emitting diode included in the subpixels in the second subpixel row, during the non-overlapping period of the second driving period, is greater than a voltage difference between the gate node and the source node of the driving transistor, during the overlapping period of the second driving period, wherein the video data voltage, supplied to the subpixels in the second subpixel row during the non-overlapping period of the second driving period is lower than the video data voltage supplied to the subpixels in the second subpixel row during the overlapping period of the second driving period.

2. The display device according to claim 1, wherein a difference between the video data voltage supplied to the subpixels in the second subpixel row during the overlapping period of the second driving period and the video data voltage supplied to the subpixels in the second subpixel row during the non-overlapping period of the second driving period, is equal to a difference between the voltage of the source node or the drain node during the overlapping period of the second driving period and the voltage of the source node or the drain node during the non-overlapping period of the second driving period.

3. The display device according to claim 1, wherein the display panel includes a plurality of data lines and a plurality of gate lines, the subpixels in the first subpixel row, the subpixels in the second subpixel row, and the subpixels in the third subpixel row are defined by the plurality of data lines and the plurality of gate lines, wherein the video data voltage is sequentially supplied to a first subpixel, a second subpixel, and a third subpixel located in the first subpixel row, the second subpixel row, and the third subpixel row, respectively, by a first data line of the plurality of data lines, the first subpixel, the second subpixel and the third subpixel are located on a same subpixel column and are electrically connected to the first data line and a first reference voltage line, and and wherein the fake data voltage is supplied simultaneously to the two or more subpixels in two or more subpixel rows through the first data line.

4. The display device according to claim 3, wherein each of the first subpixel, the second subpixel, and the third subpixel includes:

the organic light-emitting diode having a first electrode and a second electrode;

the driving transistor driving the organic light-emitting diode;

a first transistor electrically connected between a first node of the driving transistor and the first data line;

a second transistor electrically connected between a second node of the driving transistor and the first reference voltage line; and a storage capacitor electrically connected between the first node and the second node of the driving transistor, wherein the first driving period is a turn-on level period of a first scanning signal applied to a gate node of the first transistor included in the first subpixel, the second driving period is a turn-on level period of the first scanning signal applied to a gate node of the first transistor included in the second subpixel, and the third driving period is a turn-on level period of the first scanning signal applied to a gate node of the first transistor included in the third subpixel, wherein the voltage of the gate node of the driving transistor included in the second subpixel, during the non-overlapping period of the second driving period, is lower than the voltage of the gate node of the driving transistor included in the second subpixel, during the overlapping period of the second driving period.

5. The display device according to claim 4, wherein a difference between the voltage of the gate node of the driving transistor included in the second subpixel during the overlapping period and the non-overlapping period of the second driving period is equal to a difference between the voltage of the source node or the drain node during the overlapping period of the second driving period and the voltage of the source node or the drain node during the non-overlapping period of the second driving period.

6. The display device according to claim 1, wherein time lengths of the overlapping period and the non-overlapping period of the second driving period correspond to each other.

7. The display device according to claim 1, wherein the overlapping period of the second driving period overlaps a rear portion of the first driving period, with pre-charge driving being performed therein, the non-overlapping period of the second driving period does not overlap a front portion of the third driving period, with video data writing being performed therein, the video data writing is performed in the rear portion of the first driving period, and the pre-charge driving is performed in the front portion of the third driving period.

8. The display device according to claim 1, wherein the video data voltage, supplied to the subpixels in the second subpixel row during the non-overlapping period of the second driving period, varies depending on colors of light emitted by the subpixels in the second subpixel row.

9. The display device according to claim 1, wherein the video data voltage, supplied to the subpixels in the second subpixel row during the non-overlapping period of the second driving period, varies depending on gray levels of light emitted by the subpixels in the second subpixel row.

10. The display device according to claim 1, further comprising a color-specific lookup table referred to when the video data voltage, supplied to the subpixels in the second subpixel row during the non-overlapping period of the second driving period, is changed, wherein the lookup table includes information regarding gain and offset varying depending on changes in gray level or information regarding gain and offset respectively corresponding to two or more gray level ranges.

11. The display device according to claim 1, wherein the fake data voltage corresponds to a black data voltage.

12. A method of driving a display device including a display panel having a plurality of subpixels that are arrayed, the plurality of subpixels including a first subpixel row, a second subpixel row, and a third subpixel row arranged sequentially, the driving method comprising:

supplying a scanning signal having a turn-on level to subpixels in the first subpixel row during a first driving period;

supplying the scanning signal to subpixels in the second subpixel row during a second driving period starting after a start of the first driving period and before termination of the first driving period;

supplying the scanning signal to subpixels in the third subpixel row during a third driving period after termination of the second driving period, wherein, during the first, second, and third driving periods, a video data voltage is sequentially supplied to the subpixels in the first subpixel row, the subpixels in the second subpixel row, and the subpixels in the third subpixel row, wherein, during a fake data insertion period corresponding to a period between the second driving period and the third driving period, a fake data voltage, which is different from the video data voltage, is supplied to two or more of the plurality of subpixels in the display panel, wherein the second driving period includes an overlapping period that overlaps the first driving period and a non-overlapping period that does not overlap either the first driving period or the third driving period, wherein a voltage difference between a gate node and a source node of a driving transistor electrically connected to an organic light-emitting diode included in the pixels in the second subpixel row, during the non-overlapping period of the second driving period, is greater than a voltage difference between the gate node and the source node of the driving transistor, during the overlapping period of the second driving period, wherein the video data voltage, supplied to the subpixels in the second subpixel row during the non-overlapping period of the second driving period, is lower than the video data voltage supplied to the subpixels in the second subpixel row during the overlapping period of the second driving period.

13. The driving method according to claim 12, wherein a difference between the video data voltage supplied to the subpixels in the second subpixel row during the overlapping period of the second driving period and the video data voltage supplied to the subpixels in the second subpixel row during the non-overlapping period of the second driving period, is equal to a difference between the voltage of the source node or the drain node during the overlapping period of the second driving period and the voltage of the source node or the drain node during the non-overlapping period of the second driving period.

14. A data driver circuit configured to drive a plurality of data lines disposed in a display panel, the data driver circuit comprising:

a latch circuit storing video data;

a digital-to-analog converter converting the video data into an analog data voltage; and an output buffer outputting the data voltage, wherein a plurality of subpixels are arranged in the display panel, the plurality of subpixels includes a first subpixel row, a second subpixel row and a third subpixel row arranged sequentially, wherein a first driving period, in which a scanning signal having a turn-on level is supplied to subpixels in the first subpixel row, and a second driving period, in which the scanning signal having the turn-on level is supplied to subpixels in the second subpixel row, overlap each other, wherein the second driving period and a third driving period, in which the scanning signal having the turn-on level is supplied to subpixels in the third subpixel row, do not overlap each other, wherein, during the first driving period, the second driving period, and the third driving period, the output buffer sequentially supplies a video data voltage to the subpixels in the first subpixel row, the subpixels in the second subpixel row, and the subpixels in the third subpixel row through a first data line, and wherein, during a fake data insertion period corresponding to a period between the second driving period and the third driving period, the output buffer supplies a fake data voltage, which is different from the video data voltage, to two or more of the plurality of subpixels in the display panel, wherein the second driving period includes an overlapping period that overlaps the first driving period and a non-overlapping period that does not overlap either the first driving period or the third driving period, and wherein a voltage difference between a gate node and a source node of a driving transistor electrically connected to an organic light-emitting diode included in the subpixels in the second subpixel row, during the non-overlapping period of the second driving period, is greater than a voltage difference between the gate node and the source node of the driving transistor, during the overlapping period of the second driving period, wherein the video data voltage, supplied to the subpixels in the second subpixel row during the non-overlapping period of the second driving period, is lower than the video data voltage supplied to the subpixels in the second subpixel row during the overlapping period of the second driving period.

15. A controller comprising:

a driving controller controlling a data driver circuit and a gate driver circuit; and a data output portion outputting video data to the data driver circuit, wherein a plurality of subpixels are arrayed in a display panel, the display panel includes a first subpixel row, a second subpixel row and a third subpixel row arranged sequentially, wherein the driving controller controls a first driving period, in which a scanning signal having a turn-on level is supplied to subpixels in the first subpixel row, and a second driving period, in which the scanning signal having the turn-on level is supplied to subpixels in the second subpixel row, to overlap each other, wherein the driving controller controls the second driving period and a third driving period, in which the scanning signal having the turn-on level is supplied to subpixels in the third subpixel row, not to overlap each other, wherein, during the first, second, and third driving periods, the data output portion outputs the video data to the data driver circuit, the data driver circuit supplies the video data sequentially to the subpixels in the first subpixel row, the subpixels in the second subpixel row, and the subpixels in the third subpixel row, and wherein, during a fake data insertion period corresponding to a period between the second driving period and the third driving period, the data output portion outputs a fake data, which is different from the video data, to the data driver circuit, the data driver circuit supplies the fake data to two or more of the plurality of subpixels in the display panel, wherein the second driving period includes an overlapping period that overlaps the first driving period and a non-overlapping period that does not overlap either the first driving period or the third driving period, wherein a voltage difference between a gate node and a source node of a driving transistor electrically connected to an organic light-emitting diode included in the subpixels in the second subpixel row, during the non-overlapping period of the second driving period, is greater than a voltage difference between the gate node and the source node of the driving transistor, during the overlapping period of the second driving period, wherein a voltage of the video data, supplied to the subpixels in the second subpixel row during the non-overlapping period of the second driving period is lower than a voltage of the video data supplied to the subpixels in the second subpixel row during the overlapping period of the second driving period.

* * * * *